US008840101B2

(12) United States Patent
Yamada

(10) Patent No.: US 8,840,101 B2
(45) Date of Patent: Sep. 23, 2014

(54) PRINTING APPARATUS, CONTROL METHOD THEREFOR, AND STORAGE MEDIUM

(71) Applicant: Canon Kabushiki Kaisha, Tokyo (JP)

(72) Inventor: Masayuki Yamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/755,960

(22) Filed: Jan. 31, 2013

(65) Prior Publication Data

US 2013/0214481 A1 Aug. 22, 2013

(30) Foreign Application Priority Data

Feb. 22, 2012 (JP) ..... 2012-036762

(51) Int. Cl.

| | |
|---|---|
| ***B65H 5/00*** | (2006.01) |
| ***B65H 3/44*** | (2006.01) |
| ***B65H 7/02*** | (2006.01) |
| ***B65H 1/04*** | (2006.01) |
| ***G03G 15/00*** | (2006.01) |
| ***B65H 9/00*** | (2006.01) |
| ***B65H 7/20*** | (2006.01) |

(52) U.S. Cl.

CPC .. *B65H 9/00* (2013.01); *B65H 3/44* (2013.01); *B65H 2553/61* (2013.01); *B65H 7/02* (2013.01); *B65H 1/04* (2013.01); *B65H 2403/411* (2013.01); *B65H 2511/414* (2013.01); *G03G 15/6594* (2013.01); *B65H 2511/10* (2013.01); *B65H 7/20* (2013.01); *B65H 2511/416* (2013.01); *B65H 2557/23* (2013.01); *B65H 2701/1916* (2013.01); *B65H 2551/18* (2013.01); *B65H 2801/06* (2013.01); *B65H 2553/21* (2013.01); *B65H 2407/21* (2013.01); *B65H 2511/22* (2013.01); *G03G 2215/00514* (2013.01)

USPC ..... 271/2; 271/265.01

(58) Field of Classification Search

USPC ..... 271/2, 265.01; 347/104

See application file for complete search history.

(56) References Cited

U.S. PATENT DOCUMENTS

| | | | | |
|---|---|---|---|---|
| 2011/0135325 | A1 | 6/2011 | Hitaka et al. | |
| 2012/0183308 | A1 * | 7/2012 | Omori | 399/16 |
| 2013/0140754 | A1 * | 6/2013 | Nishiyama | 271/2 |
| 2013/0140767 | A1 * | 6/2013 | Inui | 271/264 |
| 2013/0168915 | A1 * | 7/2013 | Saito | 271/2 |

FOREIGN PATENT DOCUMENTS

JP 9-109492 A 4/1997

OTHER PUBLICATIONS

U.S. Appl. No. 13/758,949, filed Feb. 4, 2013. Applicant: Nobuyuki Kojima.

* cited by examiner

*Primary Examiner* — David H Bollinger

(74) *Attorney, Agent, or Firm* — Fitzpatrick, Cella, Harper & Scinto

(57) ABSTRACT

A printing apparatus according to one aspect of this invention includes a sheet holding unit configured to hold an envelope, and a detection unit configured to detect an opening width between guides for guiding an envelope held by the sheet holding unit. The printing apparatus further includes an identifying unit configured to identify a flap size of the envelope based on the opening width detected by the detection unit and a size set for the envelope held by the sheet holding unit, and a printing unit configured to print an image on the envelope by shifting image data based on the flap size identified by the identifying unit.

11 Claims, 23 Drawing Sheets

FIG. 13

| 1301 ATTRIBUTE ID | 1302 TYPE ID | 1303 VALUE | 1304 MEANING |
|---|---|---|---|
| 10 | 1 | ARBITRARY CHARACTER STRING | JOB NAME |
| 11 | 1 | ARBITRARY CHARACTER STRING | APPLICATION NAME |
| 100 | 2 | 1, 2, 3, 4, 5 or AUTO | PAPER FEED TRAY |
| 101 | 2 | 1, 2, 3, 4 | DISCHARGE TRAY |
| 104 | 2 | 3 | COPY COUNT |
| ⋮ | ⋮ | ⋮ | ⋮ |
| 401 | 11 | 0~7015, 0~9920 | IMAGE SIZE |
| 402 | 11 | 0~7015, 0~9920 | MOVING AMOUNT |
| 403 | 2 | A4, A3, B5, B4, POSTCARD, END-OPENING ENVELOPE(LONG FORMAT) 3 | PAPER SIZE |
| 404 | 2 | PLAIN PAPER, THICK PAPER, COATED PAPER, ENVELOPE | PAPER TYPE |
| 405 | 2 | 1, 2, 3 | DOUBLE-SIDED |
| 406 | 2 | 1, 2, 3, 4 | BINDING POSITION |

PRINTING APPARATUS, CONTROL METHOD THEREFOR, AND STORAGE MEDIUM

BACKGROUND OF THE INVENTION

1. Field of the Invention

The present invention relates to a printing apparatus capable of printing an image on paper such as an envelope, a control method therefor, and a storage medium.

2. Description of the Related Art

An image forming apparatus (printing apparatus) includes one or more paper containing units (sheet holding unit). The image forming apparatus feeds sheets contained in the paper containing unit one by one, and forms (prints) an image on the fed sheet. The size of paper contained in each paper containing unit can be set. For example, standard-sizes such as A4 and B4, and an arbitrary size such as 210 mm×290 mm can be set.

As a special standard-size, an envelope size can also be set. Paper with a projection such as the projecting piece, that is, margin (to be referred to as a flap hereinafter) of an envelope or the index portion of index paper is set so that the flap serves as the trailing end in the sub-scanning direction. With this setting, a paper area up to the flap is handled as a standard-size, and printing is performed. Also, there is known a technique of setting an envelope so that its flap is positioned in the sub-scanning direction, recognizing a flap position by a sensor when the envelope is conveyed, and suppressing image misregistration (see Japanese Patent Laid-Open No. 9-109492).

Paper longer in the sub-scanning direction than in the main-scanning direction, like an envelope, takes a long printing time when the long edge is made parallel to the conveyance direction and printing is performed (short-edge feed). The time necessary to print can be shortened by setting an envelope so that its flap comes to the end in the main-scanning direction, making the short edge of the envelope parallel to the conveyance direction, and printing (long-edge feed). In this case, an image needs to be shifted by the flap width and printed. However, since the flap width differs between envelope manufacturers, the user needs to enter a flap width, putting a burden on him.

SUMMARY OF THE INVENTION

The present invention solves the conventional problems.

The present invention provides a technique of identifying a flap size necessary to appropriately print an image on an envelope while suppressing the burden on the user.

According to one aspect of the present invention, there is provided a printing apparatus comprising: a sheet holding unit configured to hold an envelope; a detection unit configured to detect an opening width between guides for guiding an envelope held by the sheet holding unit; an identifying unit configured to identify a flap size of the envelope based on the opening width detected by the detection unit and a size set for the envelope held by the sheet holding unit; and a printing unit configured to print an image on the envelope by shifting image data based on the flap size identified by the identifying unit.

According to another aspect of the present invention, there is provided a method for controlling a printing apparatus including a sheet holding unit configured to hold an envelope, comprising: detecting an opening width between guides for guiding an envelope held by the sheet holding unit; identifying a flap size of the envelope based on the opening width detected in the detecting an opening width, and a size set for the envelope held by the sheet holding unit; and printing an image on the envelope by shifting image data based on the flap size identified in the identifying a flap size.

According to the present invention, a flap size necessary to appropriately print an image on an envelope can be identified while suppressing the burden on the user.

Further features of the present invention will become apparent from the following description of exemplary embodiments (with reference to the attached drawings).

BRIEF DESCRIPTION OF THE DRAWINGS

FIG. 13 is a table exemplifying attributes according to the embodiment;

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

Figure 1:
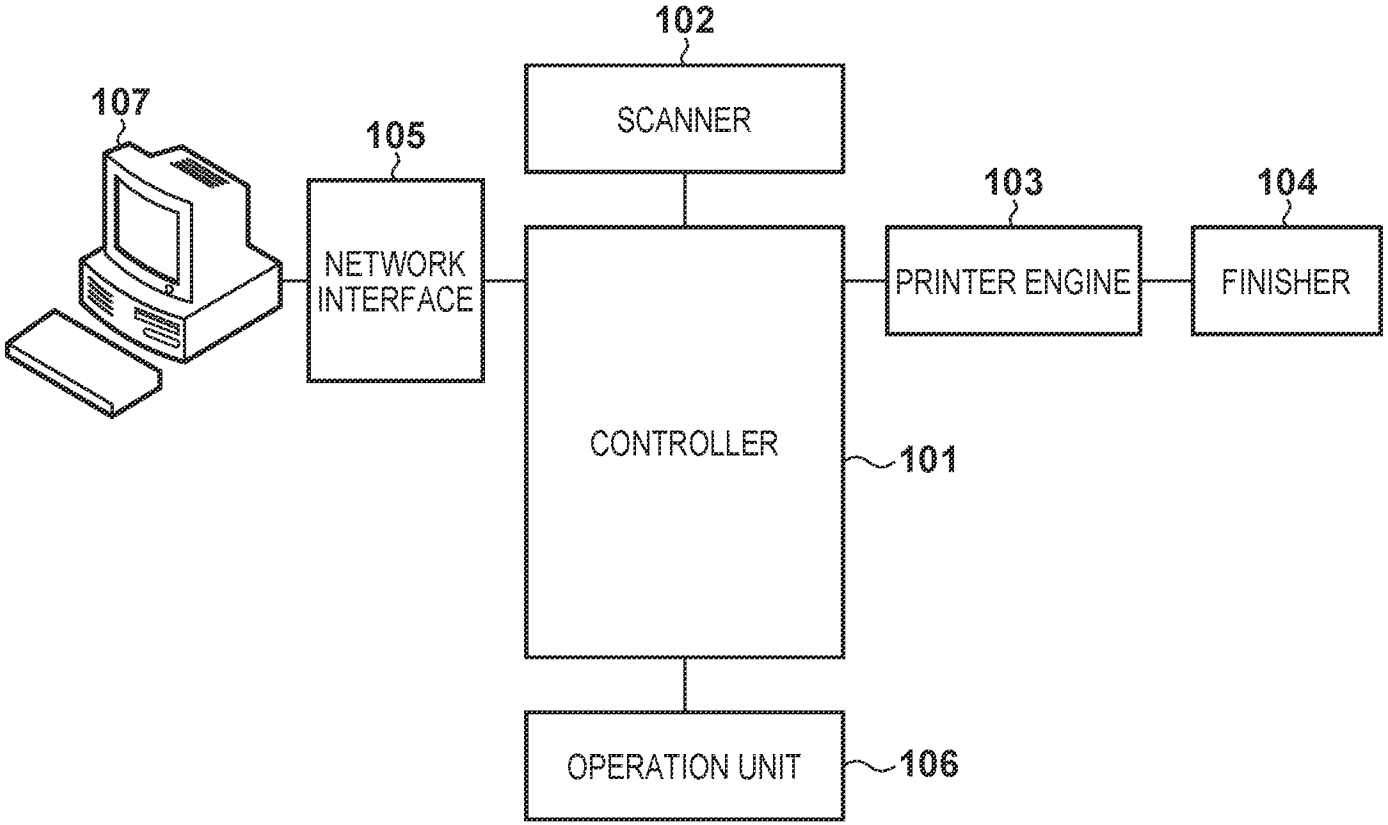
FIG. 1 is a view showing the arrangement of a multi-function peripheral (MFP) serving as an example of an image forming apparatus according to an embodiment.

FIG. 1 is a view showing the arrangement of a multi-function peripheral (MFP) serving as an example of a printing apparatus according to an embodiment of the present invention. Although the embodiment will be explained using the MFP having a plurality of functions as an example of the printing apparatus, the printing apparatus may be a single-function peripheral (SFP) having a single function.

Figure 2:
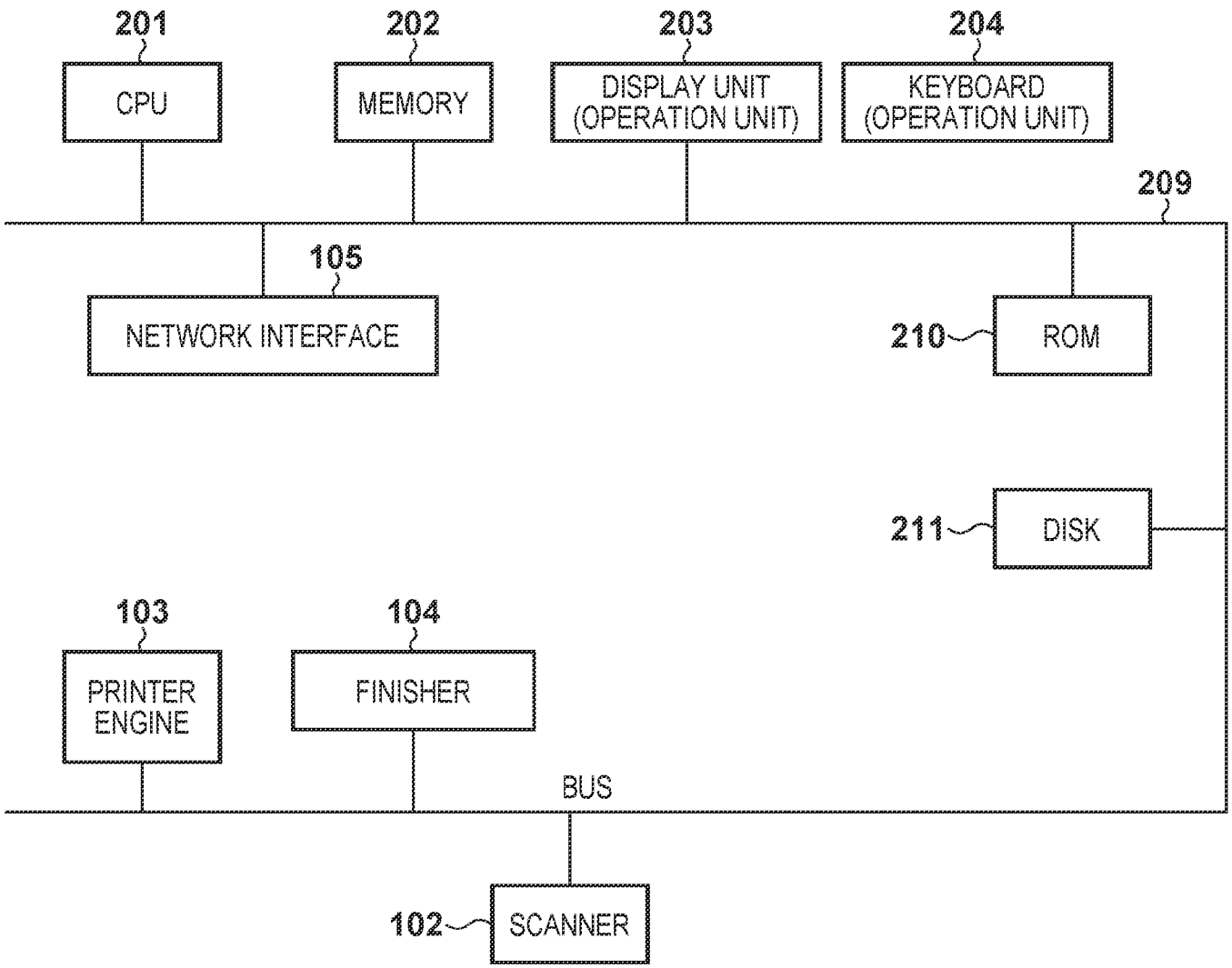
FIG. 2 is a block diagram showing the hardware arrangement of a controller according to the embodiment.

Referring to FIG. 1, a controller 101 controls the MFP, and has a hardware arrangement shown in FIG. 2. A scanner 102 is controlled by the controller 101, and scans a document to create image data of the document image. A printer engine 103 is a printer engine complying with the electrophotographic method in the embodiment. The printer engine 103 prints an image on a printing medium (sheet such as paper or envelope) under the control of the controller 101. A finisher 104 is connectable to the printer engine 103, and can perform, for example, staple processing collectively for a plurality of printing media (for example, sheets) output from the printer engine 103. The controller 101 also controls the finisher 104. A network (Ethernet) interface 105 provides two-way communication with the controller 101 via itself, and can connect the MFP to a PC 107 serving as an external apparatus via a network. An operation unit 106 provides a user interface, includes a display unit and keyboard, displays information from the controller 101, and notifies the controller 101 of an instruction from the user.

FIG. 2 is a block diagram showing the hardware arrangement of the controller 101 according to the embodiment.

In the controller 101, a CPU 201 is connected to a memory 202, a display unit 203 and keyboard 204 of the operation unit 106, a ROM 210, and a storage medium (DISK) 211 via a bus 209. Various programs and data are stored in the DISK 211 such as a hard disk or Floppy® disk, and if necessary, sequentially read out to the memory 202 and executed by the CPU 201. The DISK 211 may be one detachable from the MFP or one incorporated in the MFP. Further, programs may be downloaded from another PC, MFP, or the like via the network and stored in the DISK 211.

The memory 202 may have both the functions of volatile and nonvolatile memories. Alternatively, the memory 202 may have the function of a volatile memory, and the DISK 211 may have the function of a nonvolatile memory. The memory 202 may be a removable memory medium.

The CPU 201 writes display data in a display memory (not shown) to present a display on the display unit 203. The CPU 201 receives data from the keyboard 204 or the display unit 203 serving as a touch panel, thereby accepting input of an instruction from the user. The input information is transferred to one of the memory 202, DISK 211, and CPU 201, accumulated, and used for various processes. The network interface 105 is connected to the bus 209, and the CPU 201 performs communication via the interface by loading or writing data via the network interface 105.

Further, the printer engine 103, finisher 104, and scanner 102 are connected to the bus 209. The CPU 201 reads and writes data from and in the printer engine 103, finisher 104, and scanner 102 to execute operations such as printing and scanning, and acquire information representing various statuses. Image data can be saved in the DISK 211 or memory 202 of the controller 101 from the scanner 102 or network interface 105. Also, image data can be accumulated in advance in a removable memory and loaded by attaching the memory to the controller 101. Image data accumulated in the DISK 211 can be moved or copied to the memory 202. Various additional images (for example, a page number) can be composited with image data in the memory 202 in accordance with contents designated from the operation unit 106. Note that the printer engine 103, finisher 104, and scanner 102 may exist not in the MFP but as single peripheral devices on the network, and may be controlled by the controller 101 of the MFP.

Figure 3:
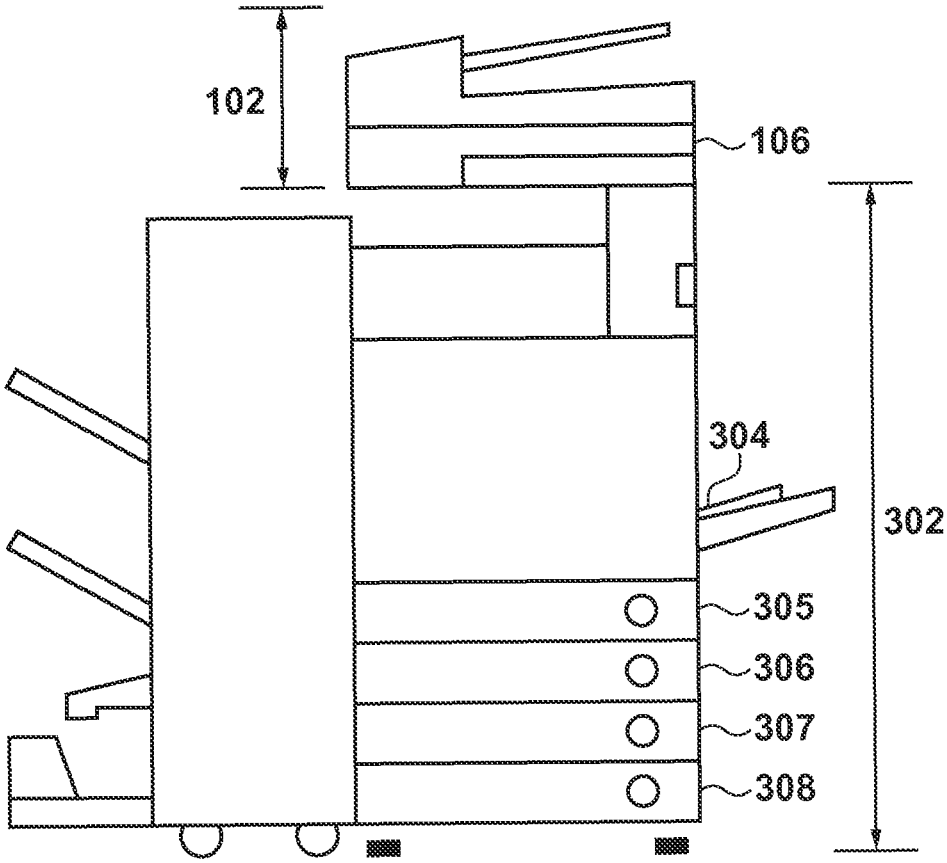
FIG. 3 is a schematic view showing the MFP according to the embodiment.

FIG. 3 is a schematic view showing the MFP according to the embodiment. Note that the same reference numerals as those in FIG. 1 denote the same parts.

The scanner 102 serving as an image input device irradiates an image on a sheet serving as a document with light, and scans a CCD line sensor to convert the document image into electrical image data. The scanner 102 determines the color and size of the document from the electrically converted image data. A printer unit 302 (printer engine 103) serving as an image output device converts image data into an image on a sheet, prints the image on a sheet, and discharges the sheet. The print operation starts and stops in accordance with instructions from the CPU 201 of the controller 101. Reference numerals 304 to 308 denote paper feed sources. The paper feed source 304 is a manual feed tray, and the paper feed sources 305 to 308 are paper feed cassettes (paper containing units or sheet holding units), in each of which a plurality of sheets (including envelopes) can be set. Note that the MFP can print, based on print data, an image on an envelope held in the manual feed tray 304 or the paper feed cassette.

Figure 4:
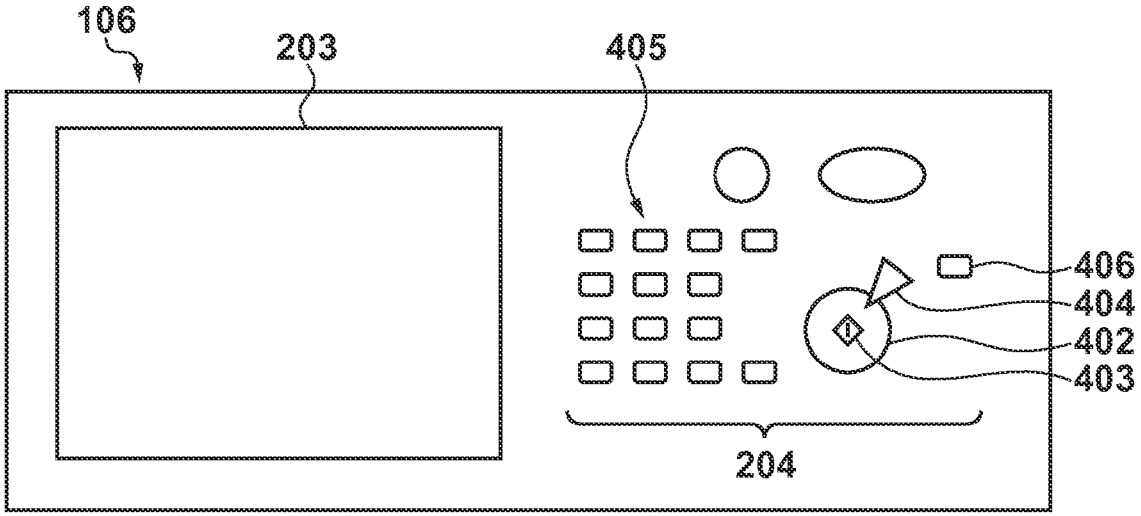
FIG. 4 is a plan view showing the operation unit of the MFP according to the embodiment.

FIG. 4 is a plan view showing the operation unit 106 of the MFP according to the embodiment.

The display unit 203 is formed from a touch panel sheet adhering to a liquid crystal display, and displays an operation screen and soft keys. When the user presses a displayed key, the display unit 203 notifies the CPU 201 of the position information.

Next, the keyboard 204 will be explained. A start key 402 is used to designate the start of a document image reading operation. An LED 403 in two, green and red colors is arranged at the center of the start key 402, and the colors represent whether the start key 402 is available. A stop key 404 is used to stop an operation in progress. A ten-key pad 405 is formed from numeric and character buttons, and used to set a copy count and designate screen switching of the display unit 203 and the like. A user mode key 406 is pressed to make settings of the MFP.

Figure 5A:
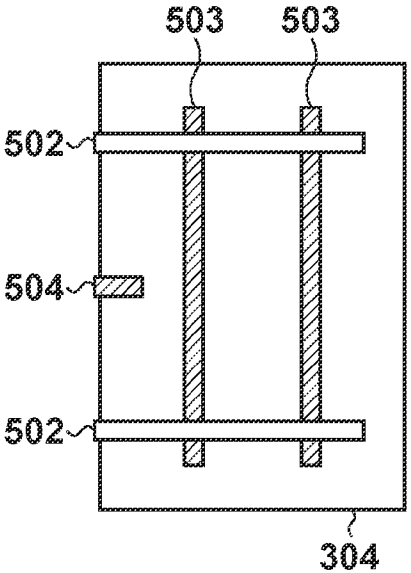
FIGS. 5A to 5D are views showing a manual feed tray when viewed from above.
Figure 5B:
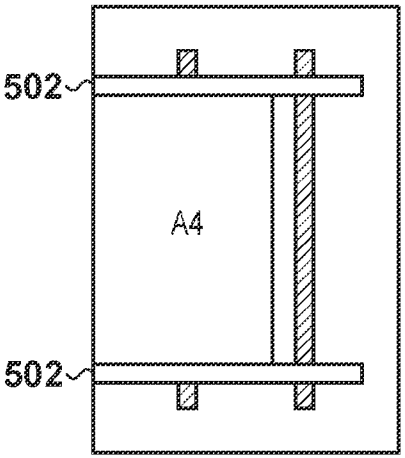
Figure 5C:
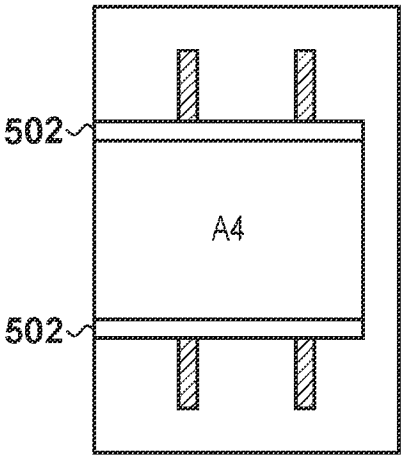

FIGS. 5A to 5C are views showing the manual feed tray 304 when viewed from above.

In FIG. 5A, the manual feed tray 304 includes guides 502 which are freely movable on rails 503. The positions of the guides 502 can be adjusted in accordance with the size of paper to be set. FIG. 5B shows guide positions when A4-size paper is set in the portrait direction. This represents a conveyance direction in long-edge feed described above. FIG. 5C shows guide positions when A4-size paper is set in the landscape direction. This represents a conveyance direction in short-edge feed described above. A sensor 504 detects that paper is placed on the manual feed tray 304. When paper is placed on the sensor 504, the controller 101 can detect, based on an output from the sensor 504, that paper is set on the manual feed tray 304.

Figure 5D:
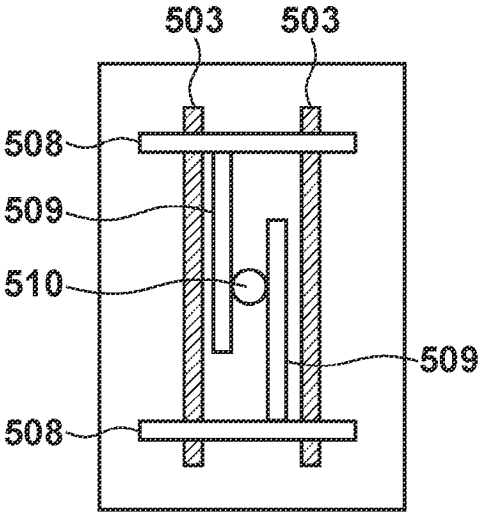

FIG. 5D shows the arrangement of the manual feed tray 304 when viewed from below. Members 508 are fixed to the guides 502 via the rails 503. Members 509 are fixed to the members 508 and move in synchronism with movement of the guides 502 and members 508. A rotation member 510 forms a rack and pinion structure with the members 509, and rotates along with movement of the members 509. The rotation member 510 includes a rotation angle sensor which can measure rotation of the rotation member 510. By measuring the rotation amount of the rotation member 510, the opening width between the guides 502 can be measured.

FIGS. 6A to 8B are views each exemplifying a UI screen displayed on the display unit 203 of the operation unit 106 of the MFP according to the embodiment. A method of setting the size and type of paper in a paper feed cassette from a user mode screen in FIG. 6A will be explained with reference to FIGS. 6A to 8B.

Figure 6A:
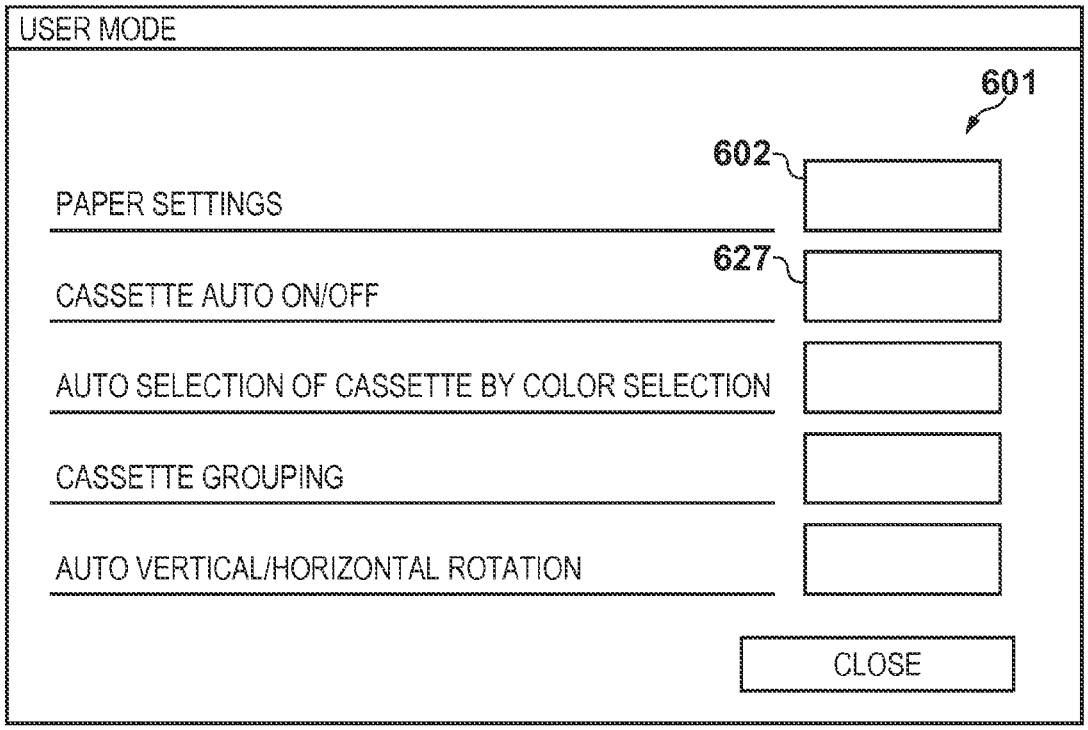
FIGS. 6A and 6B are views each showing an operation screen according to the embodiment.

When the user presses the user mode key 406 (FIG. 4) of the operation unit 106, a user mode screen in FIG. 6A appears. The user can set a paper size on this operation screen. When the user presses a paper setting button 602 in a button group 601, a screen shown in FIG. 6B for setting the size and type of paper to be set in the paper feed cassette appears.

Figure 6B:
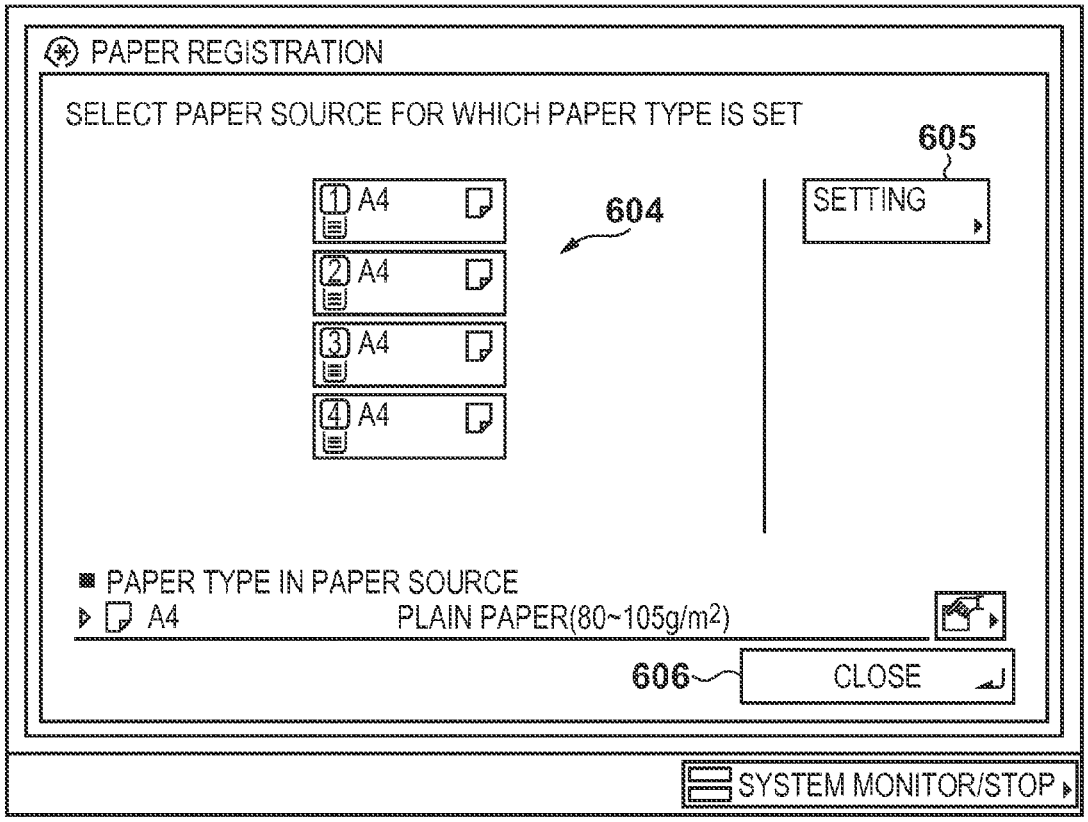

The screen in FIG. 6B provides a cassette selection button group 604. By pressing a button in the button group 604, the user can select an arbitrary paper feed cassette. When the user selects a paper feed cassette from the button group 604 and presses a set button 605, a screen shown in FIG. 7A appears.

Figure 7A:
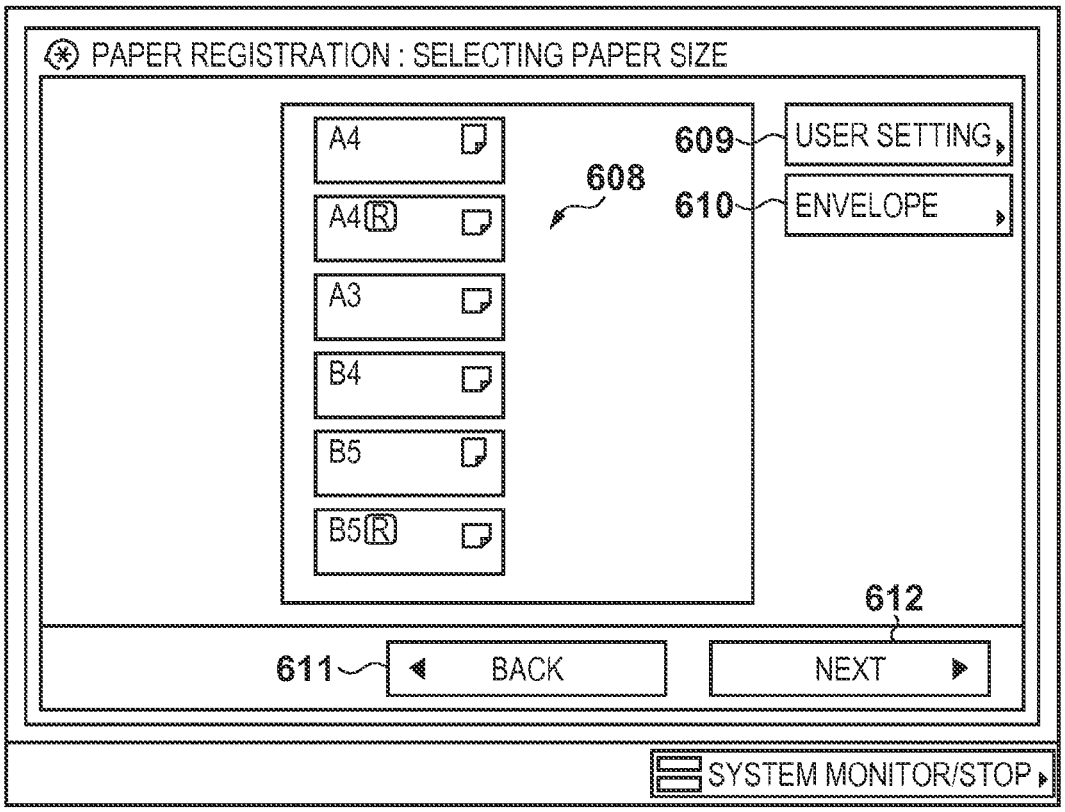
FIGS. 7A and 7B are views each showing an operation screen according to the embodiment.

The screen in FIG. 7A provides a standard-size setting button group 608. By pressing a button in the button group 608, the user can set an arbitrary standard-size for the paper feed cassette selected in FIG. 6B. The user presses a user setting button 609 to set paper of an arbitrary size. When the user presses the user setting button 609, a screen shown in FIG. 7B appears.

Figure 7B:
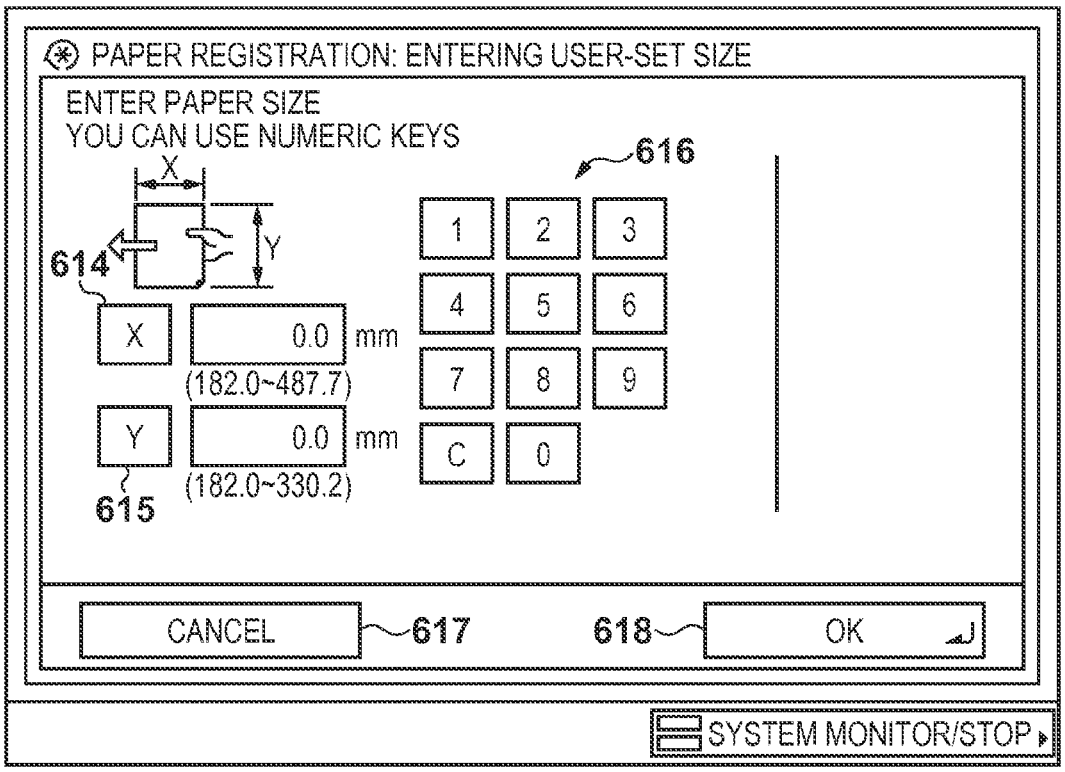

The user presses an X button 614 in FIG. 7B to set a width (dimension in the lateral direction). With a numeric button group 616, the user sets the width value. The user presses a Y button 615 to set a length (dimension in the longitudinal direction). With the numeric button group 616, the user sets the length value. The user presses a cancel button 617 to cancel settings on the screen. When the user presses the cancel button 617, the screen in FIG. 7B returns to one in FIG. 7A without any setting. The user presses an OK button 618 to end input of dimensions in the longitudinal and lateral directions, and set these values. When the user presses the OK button 618, the screen in FIG. 7B returns to one in FIG. 7A.

Figure 8A:
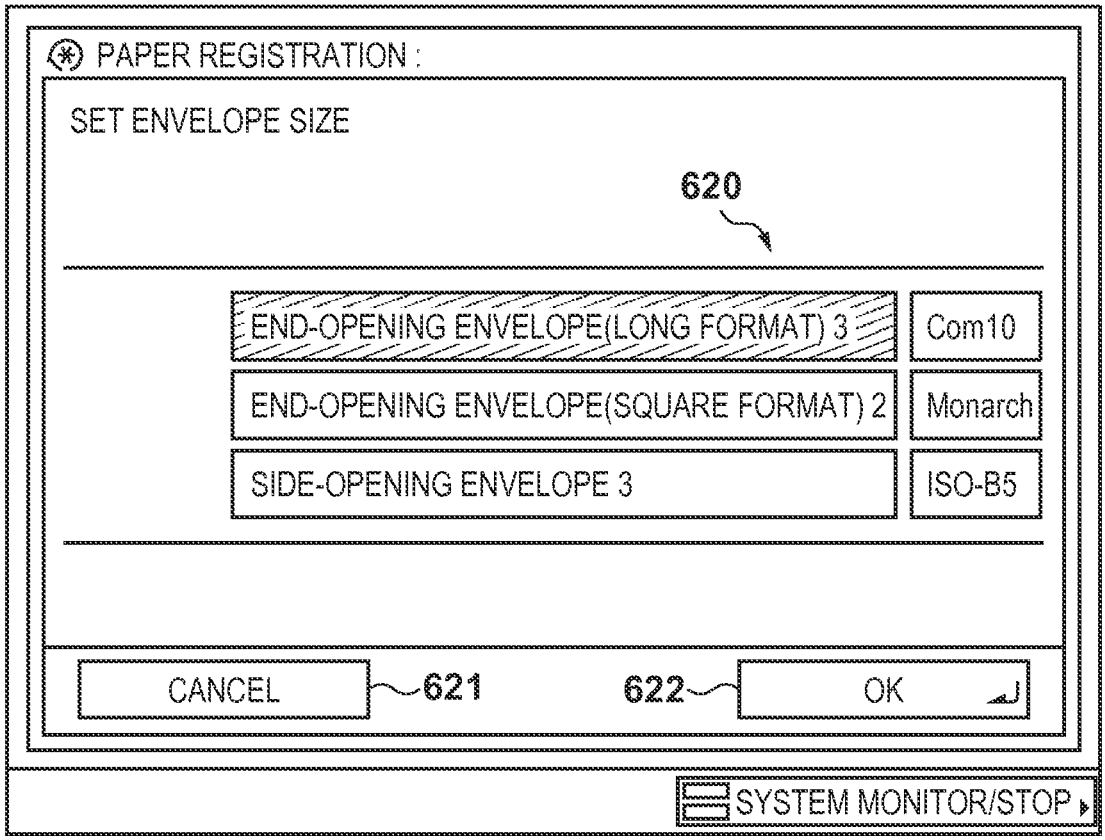
FIGS. 8A and 8B are views each exemplifying a UI screen displayed on the display unit of the operation unit of the MFP according to the embodiment.

The user presses an envelope button 610 in FIG. 7A to set an envelope size. When the user presses the envelope button 610, a screen in FIG. 8A appears. The screen in FIG. 8A provides an envelope size setting button group 620. By pressing a button in the button group 620, the user can set the standard-size of an envelope. A button corresponding to "end-opening envelope (long format) 3" is selected as a default. The default changes depending on the destination ("destination" is information indicating a country or region where a device is installed, and is saved in either the memory 202 or DISK 211 of the controller 101). The default is "end-opening envelope (long format) 3" for Japan and "Com10" for overseas. The user presses a cancel button 621 to cancel settings on the screen. When the user presses the cancel button 621, the screen in FIG. 8A returns to one in FIG. 7A without any setting. The user presses an OK button 622 to decide an envelope size. When the user presses the OK button 622, an envelope size is set, and the screen in FIG. 8A returns to one in FIG. 7A.

Figure 8B:
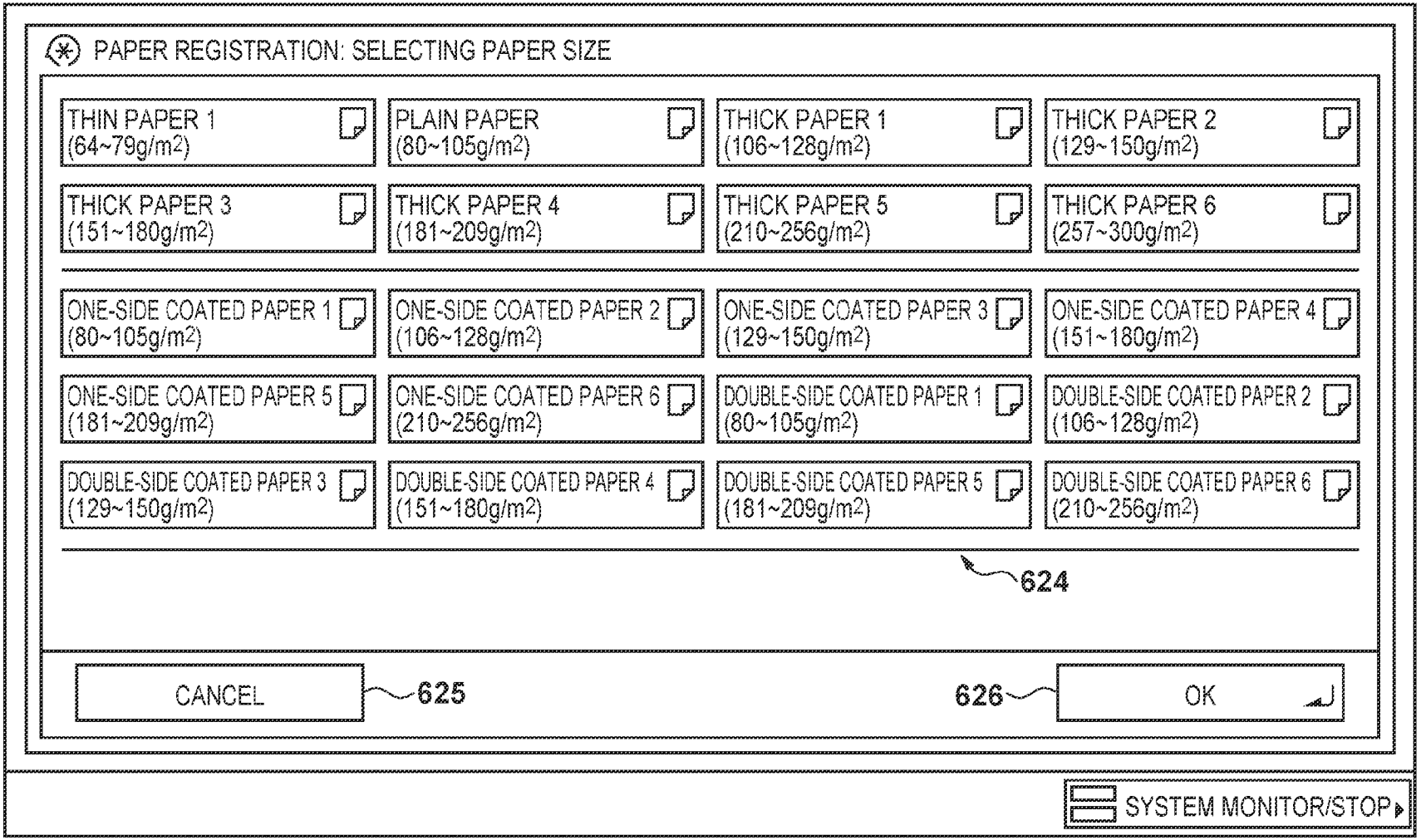

When the user sets a standard-size or user-set size as the envelope size and then presses a "Next" button 612 in FIG. 7A, a screen in FIG. 8B appears. This screen provides a paper type setting button group 624. By pressing a button in the button group 624, the user can set a paper type. The user presses a cancel button 625 to cancel settings on the screen. When the user presses the cancel button 625, the screen in FIG. 8B returns to one in FIG. 7A without any setting. The user presses an OK button 626 to decide a paper type. When the user presses the OK button 626, a paper type is set, and the screen in FIG. 8B returns to one in FIG. 6B. Further, when the user wants to set another paper feed source, he selects a paper feed cassette again from the cassette selection button group 604, and repeats setting processing. If no setting is made, the user presses a close button 606, and then the screen returns to one in FIG. 6A.

Table 1 below exemplifies information set for each paper feed cassette according to the embodiment. After the end of paper setting processing, data for one of cassette 1 to cassette 4 in Table 1 is updated. The data can be saved in either the memory 202 or DISK 211 of the controller 101.

TABLE 1

| Cassette Source | Paper Size | X Size | Y Size | Paper Type |
|---|---|---|---|---|
| Cassette 1 | A4 | — | — | Plain paper |
| Cassette 2 | End-opening envelope (long format) 3 | — | — | Thick paper |
| Cassette 3 | User setting | 200 mm | 297 mm | Plain paper |
| Cassette 4 | B4 | — | — | Plain paper |
| Manual Feed | Unset | — | — | Unset |

Next, a method of setting the size and type of paper when paper is set on the manual feed tray 304 will be explained. When the user sets paper on the manual feed tray 304 and sets a state as shown in FIG. 5B or 5C, the sensor 504 detects this and the printer engine 103 notifies the controller 101 that paper has been set. Upon receiving this notification, the controller 101 displays the screen shown in FIG. 7A on the display unit 203 of the operation unit 106. In this case, a Back button 611 is hidden. As described above, when the user sets a standard-size or user-set size as the envelope size on this screen and then presses the "Next" button 612, the screen in FIG. 8B appears. As described above, this screen provides the paper type setting button group 624. The user can set a paper type by pressing a button in the paper type setting button group 624, or return the screen in FIG. 8B to one in FIG. 7A by pressing the cancel button 625. When the user presses the OK button 626 after the end of setting, the paper registration screen disappears, and the size and paper type in "Manual Feed" of Table 1 are updated from "unset" to an actually set size and type. When the manual feed tray 304 runs out of sheets, the sensor 504 detects this, and the printer engine 103 notifies the controller 101 that sheets have run out. Upon receiving this notification, the controller 101 updates each item in "Manual Feed" of Table 1 to "unset".

Figure 9:
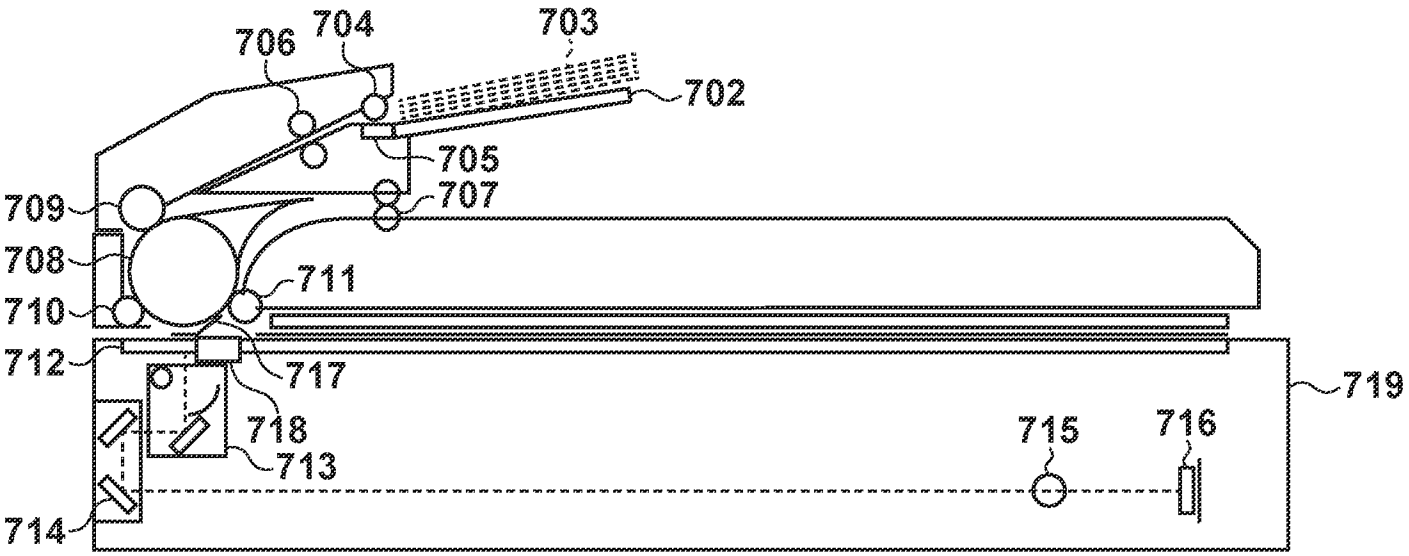
FIG. 9 is a view for explaining the structure of a scanner.

FIG. 9 is a view for explaining the structure of the scanner 102.

Information on a document 703 is read while the document 703 is moved relative to an exposure unit 713 of a document reading device 719. The document 703 is set on a document tray 702. A document feed roller 704 is paired with a separation pad 705, and conveys the documents 703 one by one. The conveyed document 703 is sent into the scanner by intermediate rollers 706, conveyed by a large roller 708 and first driven roller 709, and further conveyed by the large roller 708 and a second driven roller 710. The document 703 conveyed by the large roller 708 and second driven roller 710 passes between a sheet-fed document glass 712 and a document guide plate 717, and conveyed by the large roller 708 and a third driven roller 711 via a jump table 718. The document 703 conveyed by the large roller 708 and third driven roller 711 is discharged by a pair of document discharge rollers 707. Note that the document 703 is conveyed between the sheet-fed document glass 712 and the document guide plate 717 to contact the sheet-fed document glass 712 by the document guide plate 717.

When the document 703 passes on the sheet-fed document glass 712, the exposure unit 713 exposes a surface of the document 703 that contacts the sheet-fed document glass 712. The light reflected by the document 703 travels to a mirror unit 714. The traveling reflected light is condensed through a lens 715, and converted into an electrical signal by a CCD sensor 716. The electrical signal is transferred to the controller 101.

Figure 10:
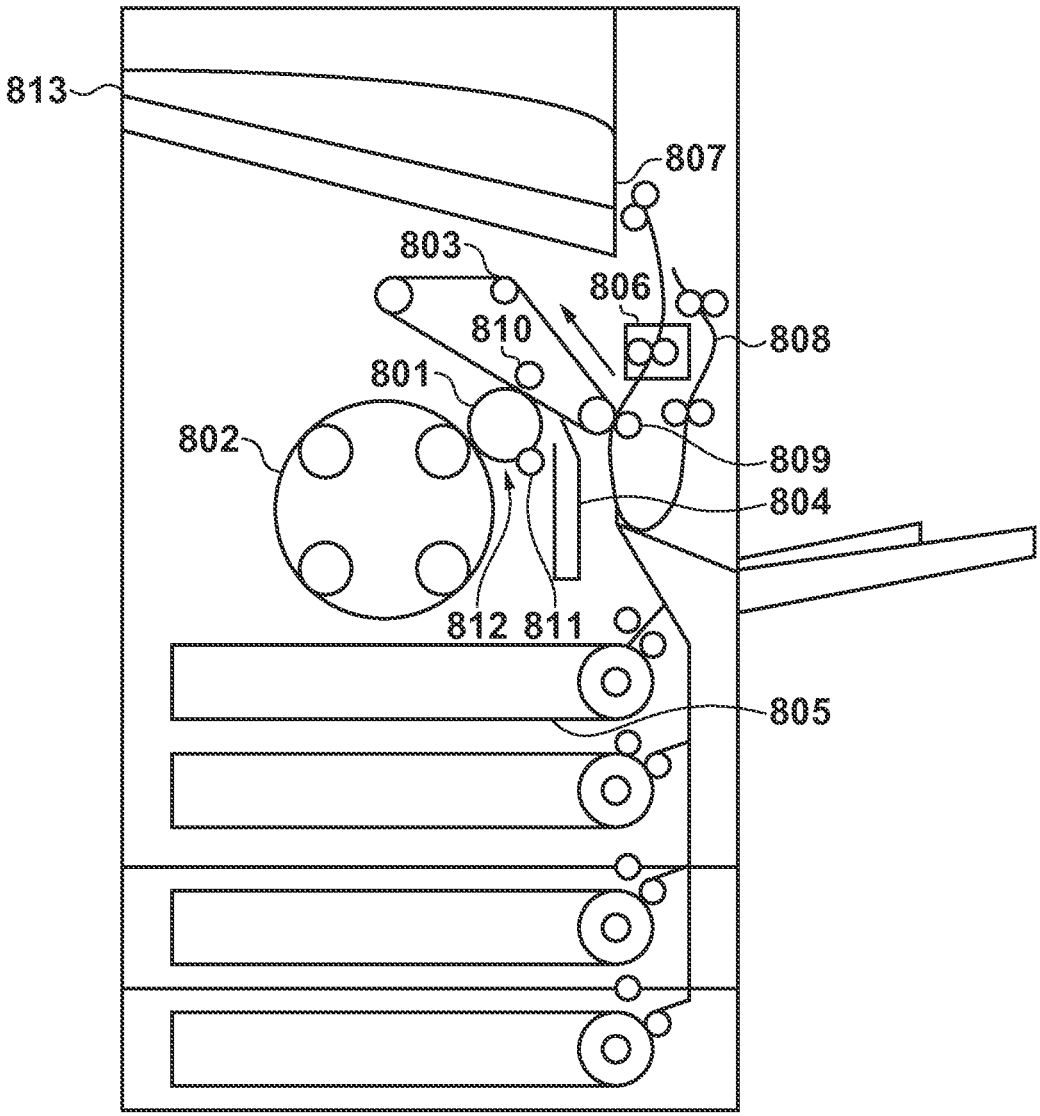
FIG. 10 is a view for explaining the arrangement of a printer unit.

FIG. 10 is a view for explaining the arrangement of the printer unit 302.

FIG. 10 exemplifies a full-color printing apparatus. A primary charger 811 charges a photosensitive drum 801 to a potential of a specific polarity, and an exposure unit (not shown) exposes a position indicated by an arrow 812 in accordance with an instruction from the controller 101. As a result, an electrostatic latent image corresponding to the first color component is formed. After that, the electrostatic latent image is developed using one of four developing units of a developing device 802. An intermediate transfer belt 803 is driven to be conveyed in a direction indicated by an arrow. When the image of the first color component formed on the photosensitive drum 801 passes through a contact portion between the photosensitive drum 801 and the intermediate transfer belt 803, it is transferred onto the intermediate transfer belt 803 by an electric field formed by a primary transfer roller 810. A cleaning device 804 cleans the surface of the photosensitive drum 801 after the end of transfer onto the intermediate transfer belt 803. This processing is sequentially repeated to transfer images of four colors onto the intermediate transfer belt 803 and superimpose them on each other, thereby forming a color image. When an image of a single color is formed, transfer processing is performed only once. The image transferred onto the intermediate transfer belt 803 is printed onto paper fed from a paper feed cassette 805 by a secondary transfer roller 809. A fixing unit 806 heats the paper and fixes the image printed on it. The paper after fixing passes through conveyance rollers, is discharged outside the apparatus from a discharge port 807, and stacked on a discharge tray 813. When double-sided printing is performed, paper is circulated through a reverse path 808 and print processing is repeated.

Figure 11:
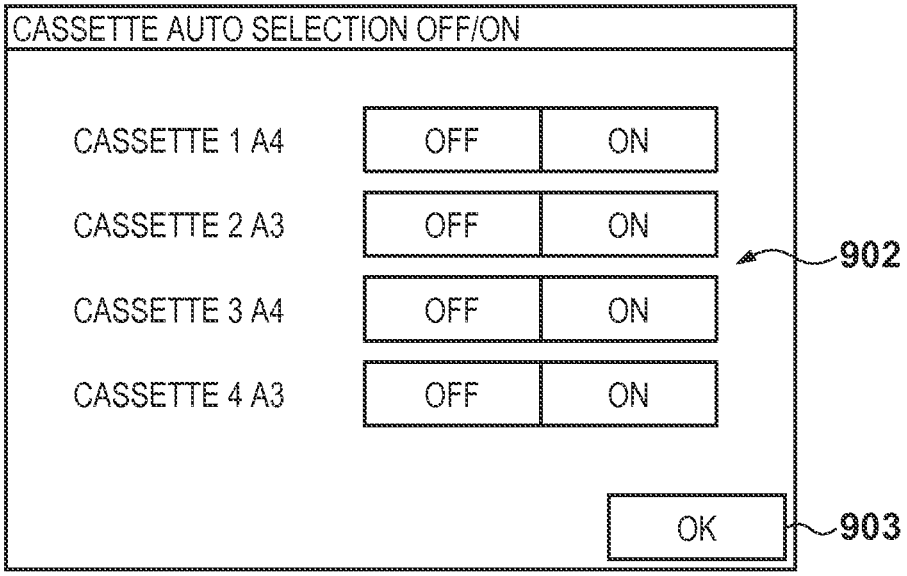
FIG. 11 is a view exemplifying a UI screen for selecting a paper feed cassette subjected to auto paper selection.

FIG. 11 is a view exemplifying a UI screen for selecting a paper feed cassette subjected to auto paper selection. Auto paper selection is processing of automatically selecting a paper feed source serving as the source of paper to be used in printing from a plurality of paper feed sources by the CPU 201 in accordance with the document size and user settings.

When the user presses the user mode key 406 of the operation unit 106, the user mode screen in FIG. 6A appears. When the user presses a button 627 corresponding to a cassette auto ON/OFF setting in the button group 601, the screen shown in FIG. 11 appears. This screen displays equipped paper feed cassettes and the size of paper set in each paper feed cassette. With a selection button group 902, the user can designate whether or not to set the paper feed cassette as a cassette to be selected automatically. A cassette source for which "ON" is pressed becomes a cassette subjected to auto paper selection. A cassette for which "OFF" is pressed becomes a cassette not subjected to auto paper selection. When the user presses an OK button 903, setting ends, and the screen in FIG. 11 returns to one in FIG. 6A.

Table 2 below exemplifies data representing auto paper selection of paper feed cassettes and a manual feed tray according to the embodiment.

After the end of cassette auto ON/OFF setting processing, data for one of cassette 1 to cassette 4 and the manual feed tray in Table 2 is updated in correspondence with the setting. The data can be saved in either the memory 202 or DISK 211 of the controller 101. This data is used when automatically selecting a cassette. In the example of Table 2, it is set to use all cassettes 1 to 4 in auto paper switching and not to use only the manual feed tray in auto paper switching.

TABLE 2

| Cassette | State |
|---|---|
| Cassette 1 | ON |
| Cassette 2 | ON |
| Cassette 3 | ON |
| Cassette 4 | ON |
| Manual Feed | OFF |

Figure 12:
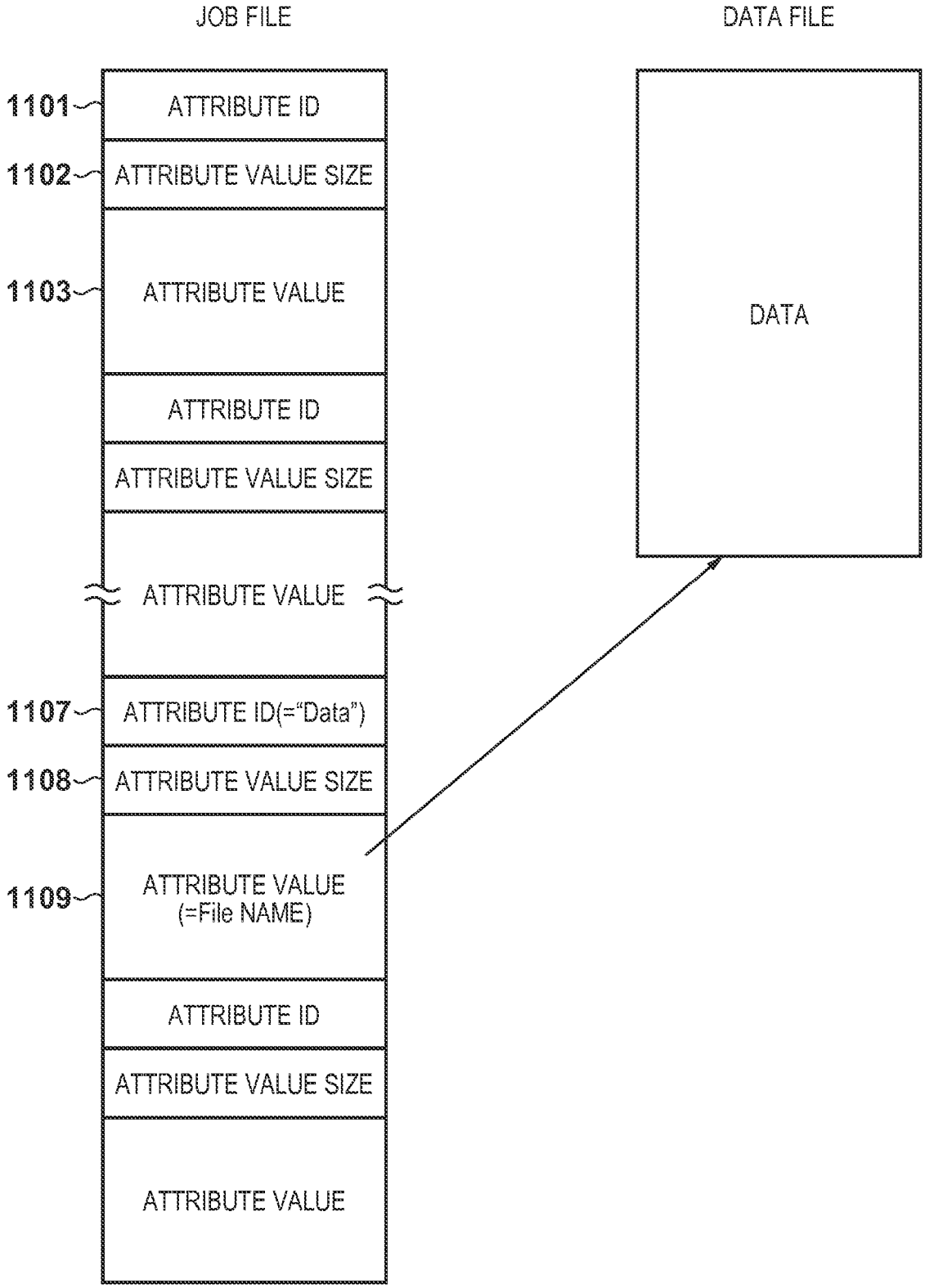
FIG. 12 is a view for explaining the data structure of a print job in the embodiment.

FIG. 12 is a view for explaining the data structure of a print job in the embodiment. This data is generated by an application in the device upon receiving an instruction to execute a print job.

The entity of the job is represented by successively arranging a plurality of sets each of an attribute ID 1101, attribute value size 1102, and attribute value 1103. When a job contains data, it holds a value representing data as an attribute ID, the size of a file name as an attribute value size, and the file name of a file holding document data as an attribute value, as represented by 1107, 1108, and 1109. Each attribute value contains a data format (for example, PDL used), copy count, cassette source, paper size used in printing, and designation of finishing processing.

FIG. 13 is a table exemplifying attributes according to the embodiment.

An attribute ID 1301 represents the identification number (ID) of an attribute. A type ID 1302 represents the type (size) of an ID, which is set in advance such that "1" is an undefined length and "2" is 1 byte. A value 1303 represents a possible value and has a meaning as represented by a meaning 1304. The attributes shown in FIG. 13 are merely examples, and there are various other attributes. A job is formed by setting these values in the attribute ID, attribute size, and attribute value of a job shown in FIG. 12.

Figure 14:
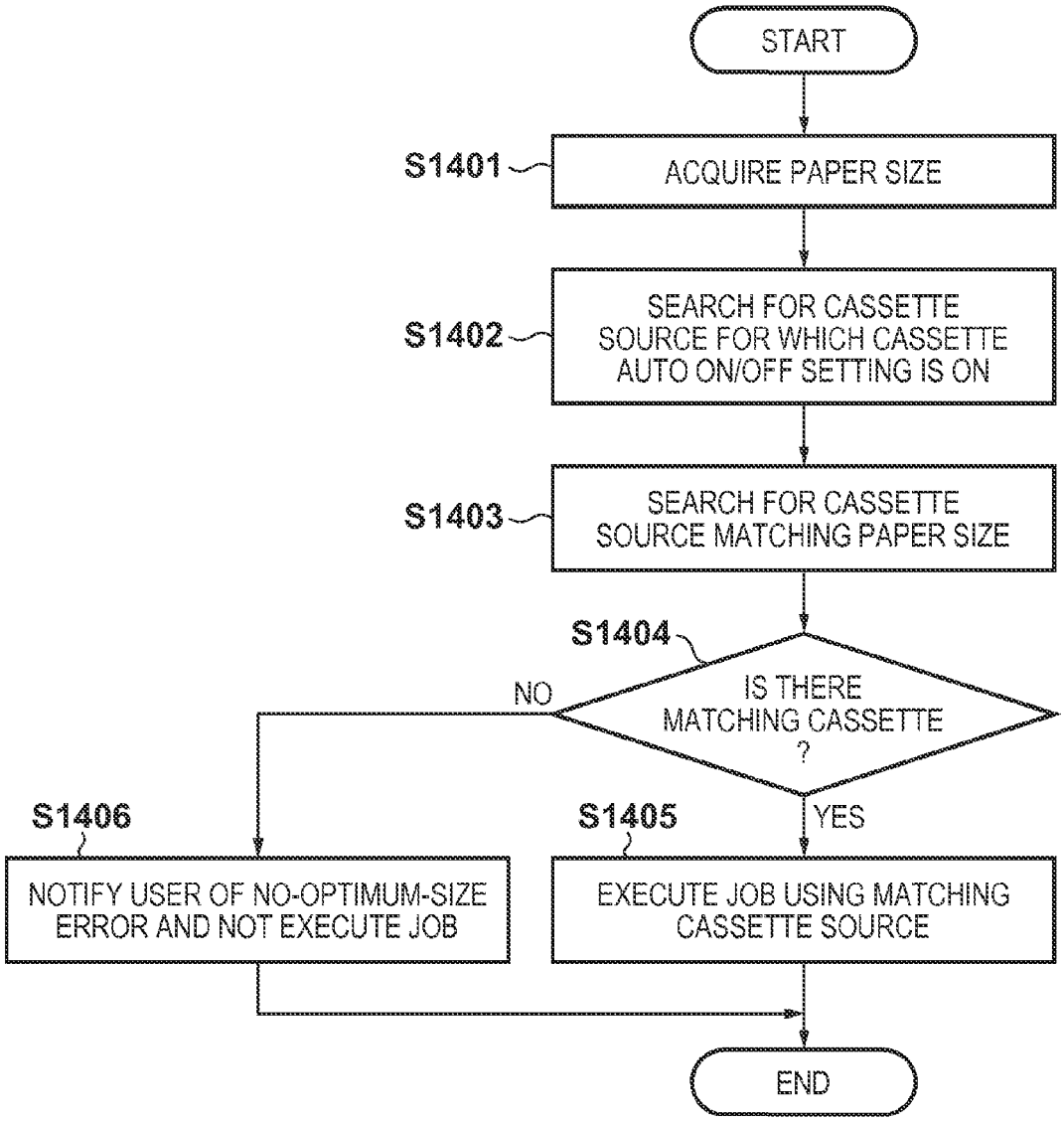
FIG. 14 is a flowchart showing an operation of automatically switching a cassette source in the MFP according to the embodiment when sheets run out during printing by a print job for which a paper size is designated.

FIG. 14 is a flowchart showing an operation of automatically switching a cassette source in the MFP according to the embodiment when sheets run out during printing by a print job for which a paper size is designated. Note that a program for executing this processing is stored in the ROM 210 or DISK 211, loaded in the memory 202 in execution, and executed under the control of the CPU 201.

When auto cassette switching processing starts after a job is interrupted due to the absence of sheets, the CPU 201 acquires a paper size requested of processing from an attribute designated by the job in step S1401. The process advances to step S1402, and the CPU 201 searches for a cassette whose state is set to ON in Table 2. The process then advances to step S1403, and the CPU 201 compares the paper size acquired in step S1401 with the paper sizes of respective cassettes whose states are ON in step S1402, and determines whether there is a cassette matching the paper size. For example, when the paper size acquired in step S1401 is B4, it is detected that B4-size sheets are set in cassette 4 out of target cassettes 1 to 4 (see Table 1). If all cassette auto ON/OFF settings are "OFF" in Table 2 or a cassette containing B4-size sheets does not exist in Table 1, there is no matching cassette.

In step S1404, the CPU 201 determines whether there is a matching cassette. If there is a matching cassette, the process advances to step S1405, and the CPU 201 restarts the job by using the cassette source matching the size. If the CPU 201 determines in step S1404 that there is no matching cassette, the process advances to step S1406, and the CPU 201 notifies the user that there is no usable size, and keeps interrupting the job.

An envelope size setting method according to the embodiment will be explained with reference to FIGS. 15A, 15B, and 16.

When paper is set on the manual feed tray 304, the operation unit 106 displays the screen in FIG. 7A. If the user presses the envelope button 610 on this screen, a screen in FIG. 15A appears. The screen provides an envelope size setting button group 1402. By pressing a button in the button group 1402, the user can set an envelope size. With the button, end-opening envelope (long format) 3 is selected as a default. When the user presses a "longitudinal feed" button 1403 in the screen, the screen changes to a setting screen shown in FIG. 15B for longitudinal feed in which an envelope is printed with its short edge set parallel to the main-scanning direction. Similarly, when the user presses a "lateral feed" button 1408 in the screen of FIG. 15B, the screen changes to a lateral feed setting screen shown in FIG. 15A. The screens in FIGS. 15A and 15B include the envelope size setting button group 1402 and an envelope size setting button group 1407, respectively. By pressing a button in these button groups, the user can set an envelope size. The user presses a cancel button 1404 or 1409 to cancel settings on the screen. When the user presses the cancel button 1404 or 1409, the setting screen returns to the screen in FIG. 7A without any setting on the setting screen.

Figure 15A:
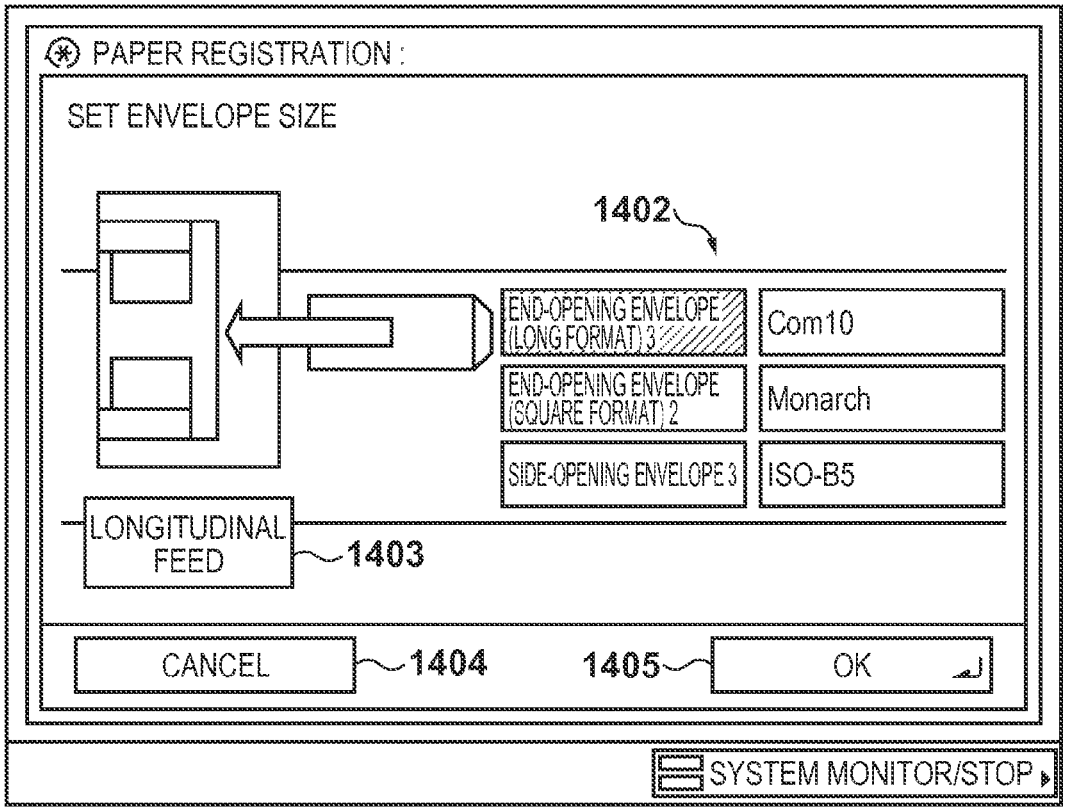
FIGS. 15A and 15B are views for explaining an envelope size setting method according to the embodiment.
Figure 15B:
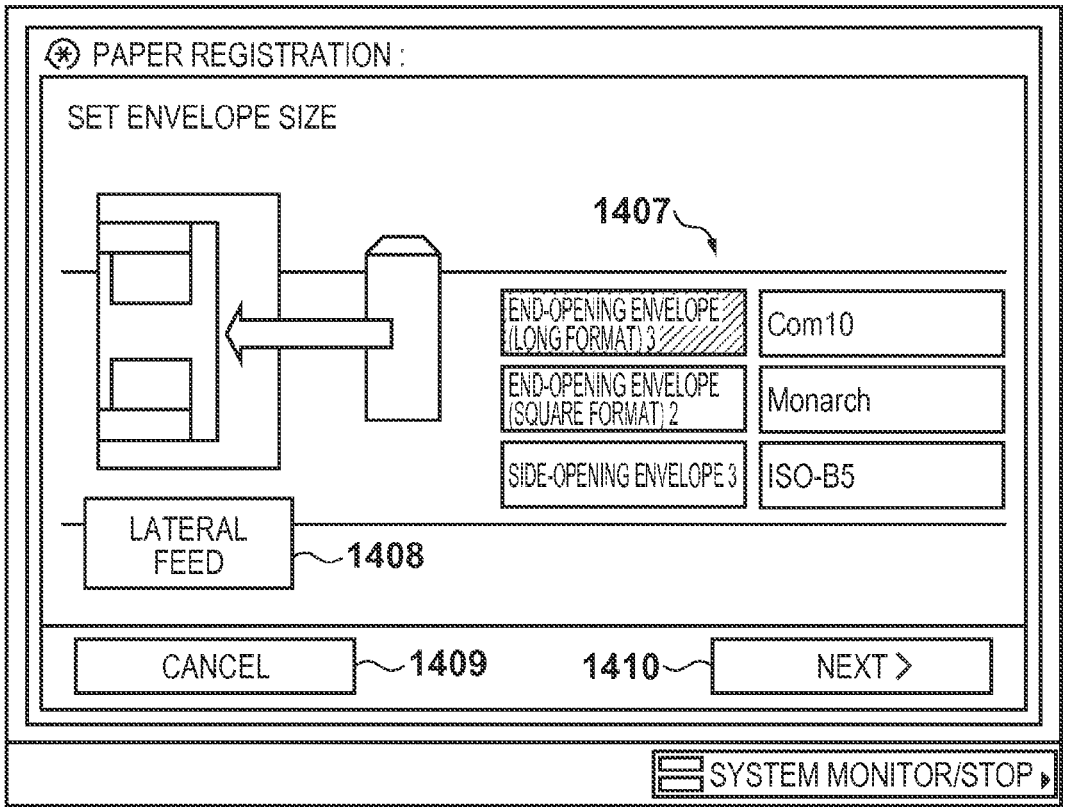

When the user presses an OK button 1405 in the envelope lateral feed screen of FIG. 15A, setting of an envelope paper size is executed and the screen disappears. The envelope longitudinal feed screen in FIG. 15B displays not the OK button but a "Next" button 1410. When the user presses the "Next" button 1410, the screen changes to a flap size setting screen in FIG. 16.

This screen includes a numeric value input area 1413 for setting a flap size. By using a numeric key group 1412, the user can enter a flap size setting value to the numeric value input area 1413. As a value in the numeric value input area 1413 in the flap size setting screen, a flap size which has been set for the selected envelope size is acquired from a memory having the data structure shown in Table 3, and displayed. Hence, a flap size which has been set previously in association with the envelope size is displayed. The user presses a cancel button 1414 to cancel settings on the screen. When the user presses the cancel button 1414, the screen in FIG. 16 returns to one in FIG. 15B.

Figure 16:
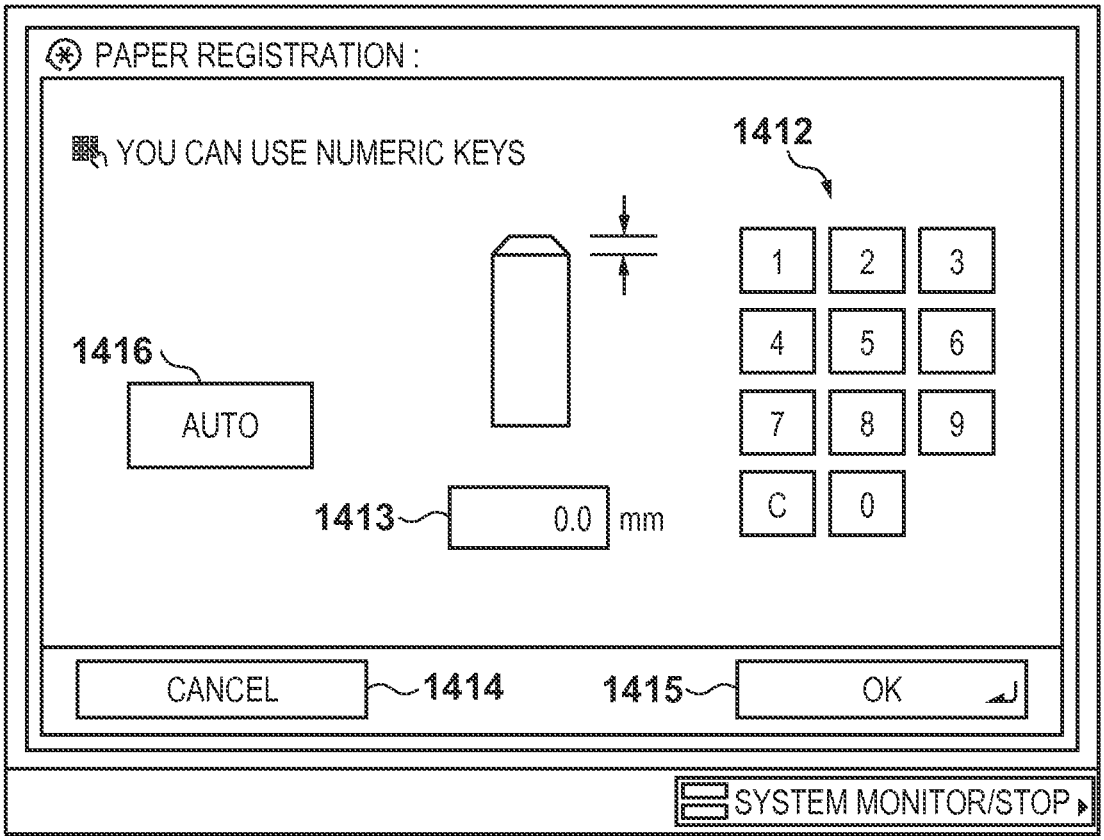
FIG. 16 is a view exemplifying a flap size setting screen.

An auto button 1416 is arranged on the flap size setting screen of FIG. 16. When the user presses the auto button 1416, "auto" is displayed in the numeric value input area 1413, and the auto button 1416 is highlighted. This means that a flap size is acquired automatically. When the user presses the numeric key group 1412 while the auto button 1416 is highlighted, the highlight of the auto button 1416 is canceled, and an entered numeric value is displayed in the numeric value input area 1413.

Table 3 below shows a data structure used in processing according to the embodiment. After the end of envelope setting processing, data of either the flap size or auto flag in Table 3 is updated. The data can be saved in either the memory 202 or DISK 211 of the controller 101. Assume that "reference size" in Table 3 is set in advance in association with an envelope size.

TABLE 3

| Envelope Size | Reference Size | Auto Flag | Flap Size |
|---|---|---|---|
| 1: COM10 | 104.8 mm | | 0.0 mm |
| 2: Monarch | 98.4 mm | | 0.0 mm |
| 3: ISO-C5 | 229 mm | | 0.0 mm |
| 4: End-opening Envelope (Long Format) 3 | 235 mm | | 0.0 mm |
| 5: Side-opening Envelope 3 | 120 mm | | 0.0 mm |
| 6: End-opening Envelope (Square Format) 2 | 332 mm | | 0.0 mm |

Figure 17A:
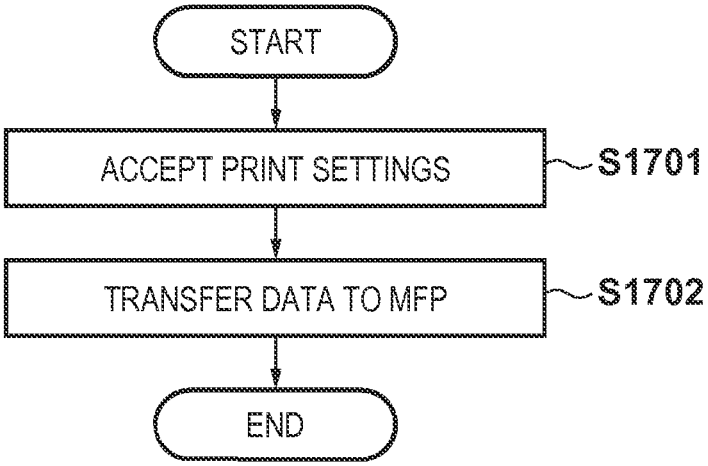
FIGS. 17A and 17B are flowcharts for explaining a printing sequence of PDL data on an envelope by a print job according to the embodiment.
Figure 17B:
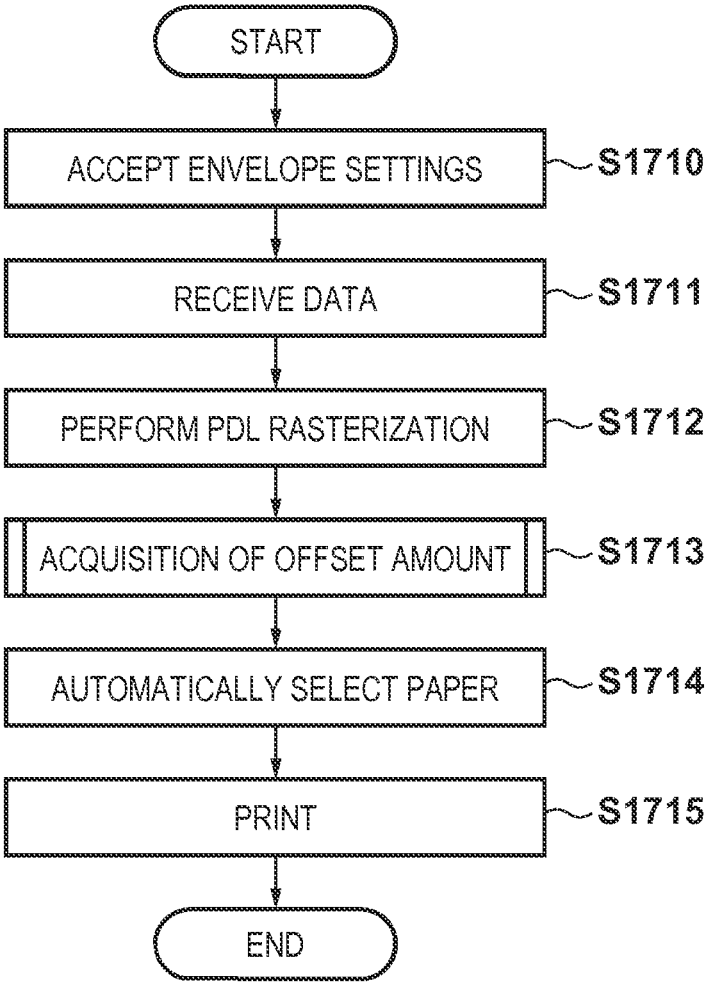

FIGS. 17A and 17B are flowcharts for explaining a printing sequence of PDL data on an envelope by a print job according to the embodiment. FIG. 17A shows processing by the PC 107, and FIG. 17B shows processing by the MFP according to the embodiment. Note that the processing shown in the flowchart of FIG. 17A is implemented by reading out a program stored in the ROM (not shown) of the PC 107 and executing it by the CPU (not shown) of the PC 107. Also, the processing shown in the flowchart of FIG. 17B is implemented by reading out a program stored in the ROM 210 and executing it by the CPU 201.

First, in step S1701 of FIG. 17A, the PC 107 accepts the print settings of a PDL image output job from the user. The print setting contents include the copy count, paper size (envelope size in printing on an envelope), single-sided/double-sided, page output order, sort output, and stapling/no-stapling. Then, the process advances to step S1702, and the PC 107 accepts a print instruction from the user, and converts code data to be printed into so-called PDL data (print data) by using driver software installed in the PC 107. The PC 107 transfers the PDL data to the controller 101 via the network interface 105 together with the print setting parameters set in step S1701.

Next, processing by the MFP will be explained with reference to FIG. 17B.

Figure 20A:
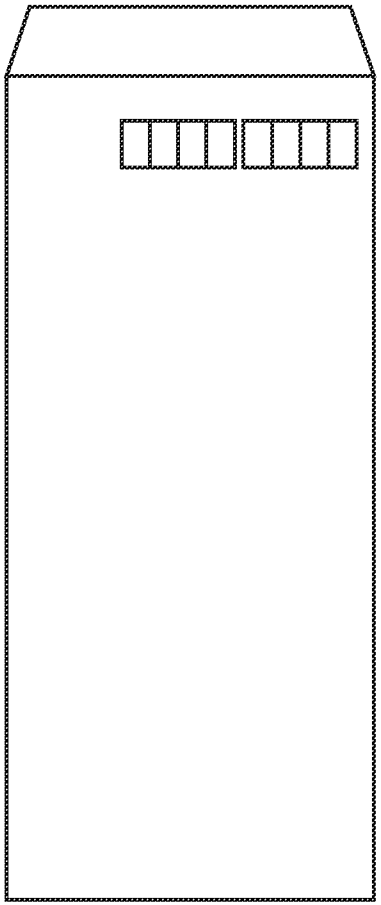
FIGS. 20A to 20C are views for explaining an envelope of end-opening envelope (long format) 3, and examples of printing an image on the envelope.

In step S1710, the CPU 201 detects that, for example, an envelope of end-opening envelope (long format) 3 in FIG. 20A is set on the manual feed tray 304. The user selects the "longitudinal feed" 1403 in FIG. 15A, and sets "end-opening envelope (long format) 3" as the envelope size in FIG. 15B. In response to this, the items of "Manual Feed" in Table 1 are updated as shown on the upper side of Table 4.

When it is set to automatically acquire a flap size in flap size setting, the items of "end-opening envelope (long format) 3" in Table 3 are updated as shown on the lower side of Table 4. A comparison between Table 3 and Table 4 reveals that "auto flag" representing to automatically set the flap size of "end-opening envelope (long format) 3" is updated to "Yes" in Table 4.

TABLE 4

| Cassette Source | Paper Size | X Size | Y Size | Paper Type |
|---|---|---|---|---|
| Manual Feed | End-opening envelope (long format) 3 | — | — | Envelope |

| Envelope Size | Reference Size | Auto Flag | Flap Size |
|---|---|---|---|
| 4: End-opening Envelope (Long Format) 3 | 235 mm | Yes | 0.0 mm |

In step S1711, the CPU 201 receives the PDL data transferred from the PC 107 via the network interface 105. The process advances to step S1712, and the CPU 201 rasterizes the PDL data into image data based on the print setting parameters. Rasterization into image data is executed in the memory 202.

Figure 21:
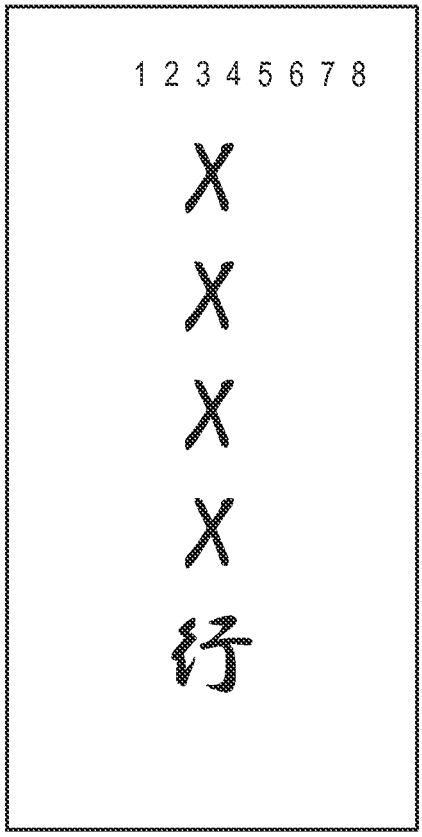
FIG. 21 is a view showing an image of image data rasterized in a memory when end-opening envelope (long format) 3 is set as the image size.

FIG. 21 is a view showing an image of image data rasterized in the memory when end-opening envelope (long format) 3 is set as the image size.

End-opening envelope (long format) 3 is defined by a size of 120 mm×235 mm. Image data of a size corresponding to this size is rasterized in the memory 202.

After that, the process advances to step S1713, and the CPU 201 acquires an offset amount based on the paper size (envelope size) designated by the PDL job. The offset amount acquisition processing will be described in detail with reference to the flowchart of FIG. 18.

The process advances to step S1714, and the CPU 201 selects a paper feed source matching the acquired paper size. Since the designated paper size is end-opening envelope (long format) 3, the CPU 201 selects a paper feed source (manual feed tray in this case) in which an envelope of end-opening envelope (long format) 3 is set, and acquires a paper feed direction set for the paper feed source.

Figure 20B:
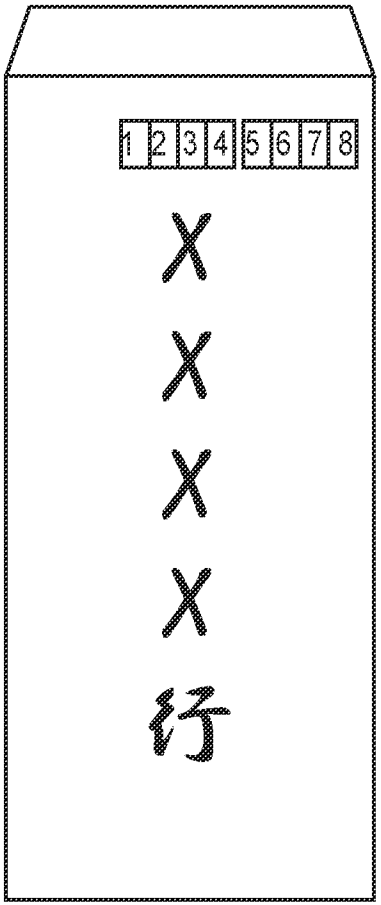
Figure 20C:
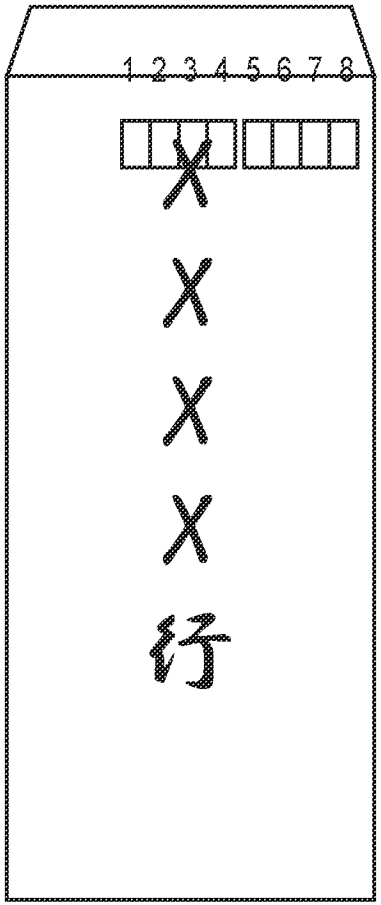

The process advances to step S1715, and the CPU 201 controls the printer engine 103 to perform printing control based on image data. At this time, the image is printed by shifting the image data output position by the offset amount in the sub-scanning direction. Accordingly, a printing result as shown in FIG. 20B can be acquired. If the image data output position is not shifted by the offset amount, the printing result becomes one as shown in FIG. 20C in which the positions of the address and postal code shift from correct positions. This is because, if an image rasterized in the memory 202 is printed on an envelope with its upper end aligned with the upper end of the envelope, similar to printing an image on paper other than an envelope, the image is not printed at a correct position owing to the presence of the flap of the envelope.

Figure 18:
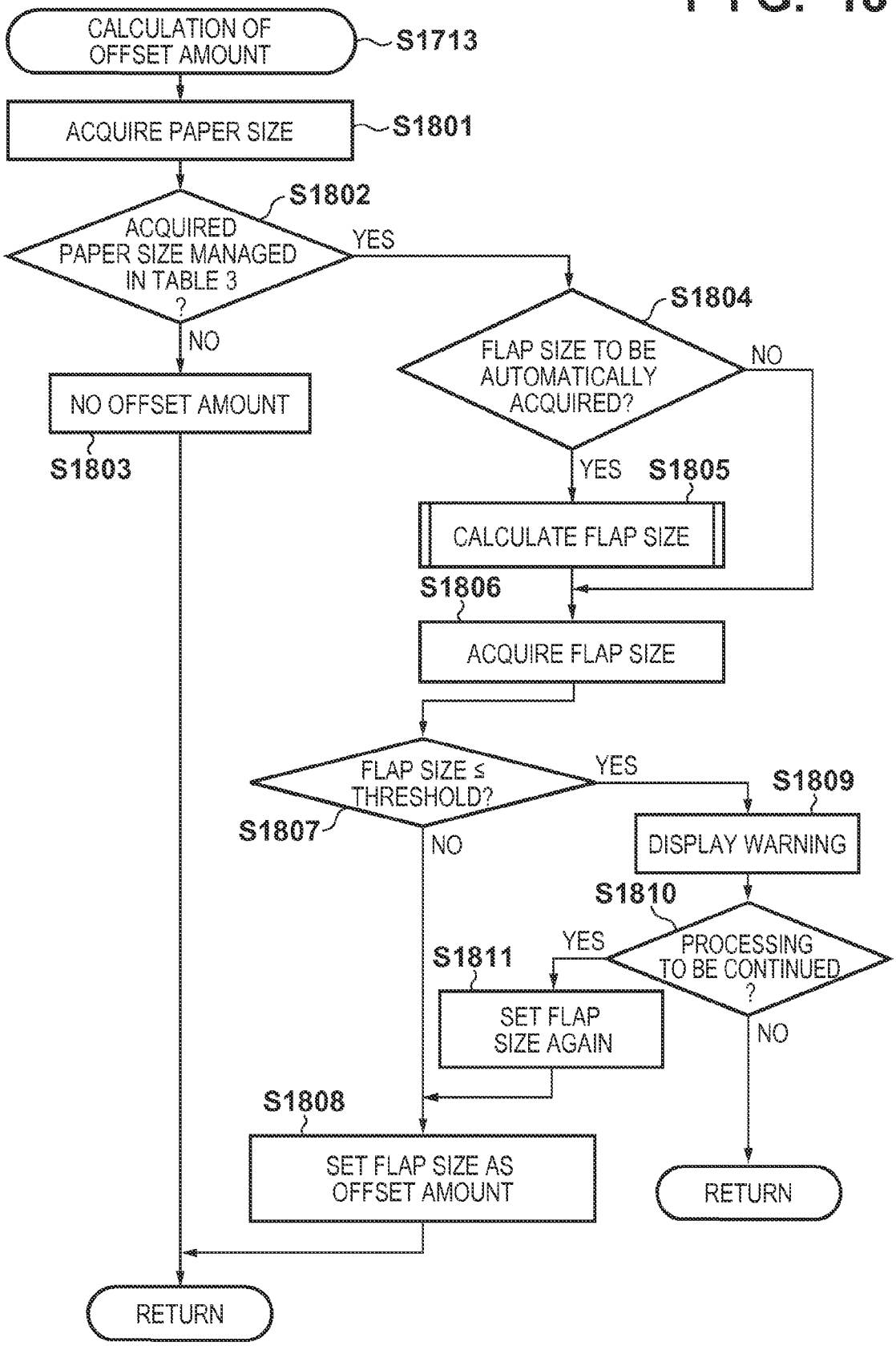
FIG. 18 is a flowchart for explaining offset amount acquisition processing in step S1713 of FIG. 17B.

FIG. 18 is a flowchart for explaining offset amount acquisition processing in step S1713 of FIG. 17B. This processing is implemented by reading out a program stored in the ROM 210 and executing it by the CPU 201.

First, in step S1801, the CPU 201 acquires a paper size designated by the PDL job from attributes. The process advances to step S1802, and the CPU 201 determines whether the acquired paper size coincides an envelope size managed in Table 3. If no coincident size exists in Table 3 in step S1802, the process advances to step S1803, the CPU 201 determines that no offset amount is set, and the process returns to the processing in FIG. 17B. If a coincident size exists in Table 3 in step S1802, the process advances to step S1804, and the CPU 201 determines whether it is set to automatically acquire a flap size, that is, the auto flag is "Yes". If the auto flag is set to be "Yes", the process advances to step S1805; if it is set to be "No", to step S1806. In step S1805, the CPU 201 calculates a flap size based on the reference size in Table 3 and the opening width between the guides 502 (FIG. 5D).

Figure 19:
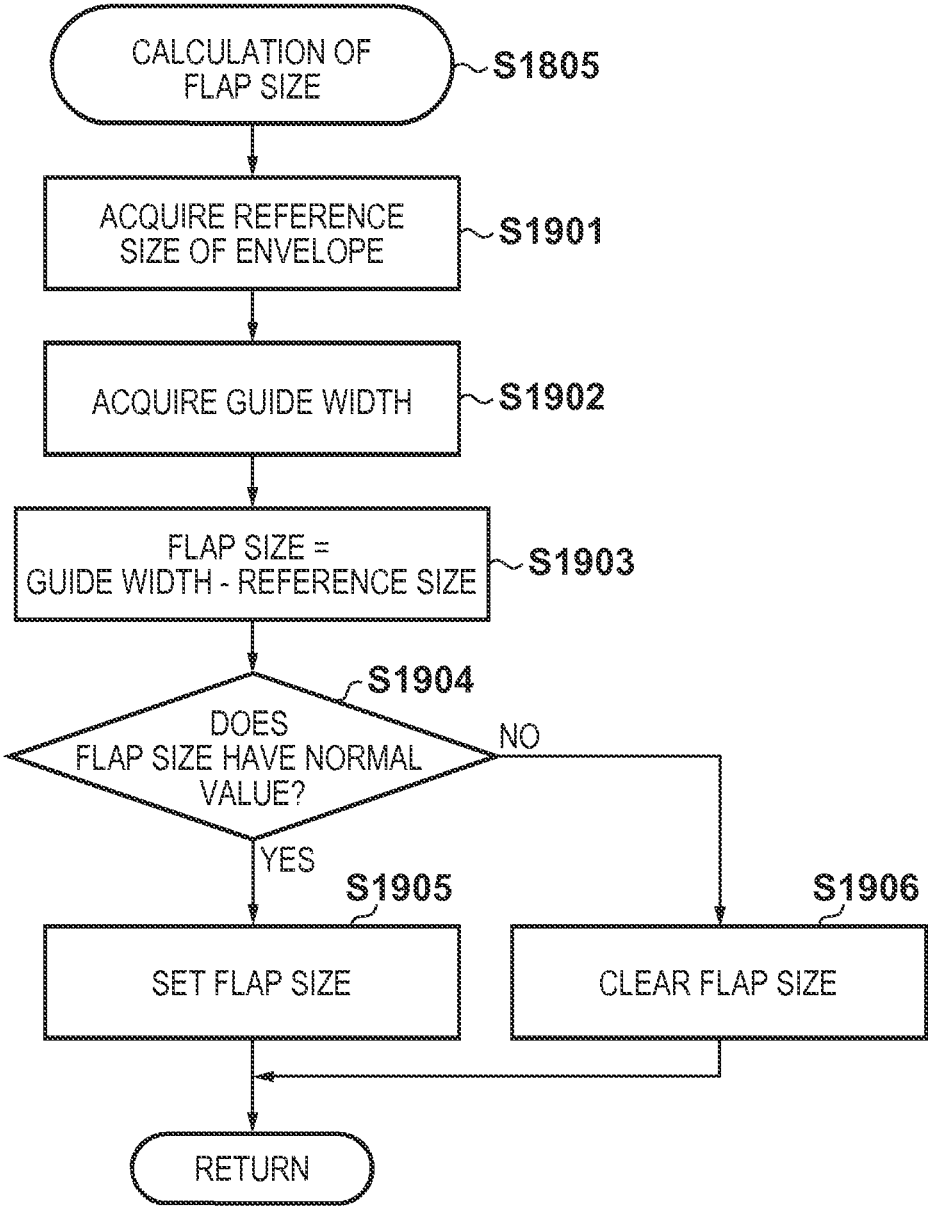
FIG. 19 is a flowchart for explaining processing in step S1805 of FIG. 18.

FIG. 19 is a flowchart for explaining processing in step S1805 of FIG. 18.

In step S1901, by looking up Table 3, the CPU 201 acquires a reference size corresponding to the paper size (envelope size) acquired in step S1801. For example, when the envelope size is end-opening envelope (long format) 3, "235 mm" is acquired as the reference size. The process advances to step S1902, and the CPU 201 acquires the opening width between the guides 502. More specifically, the opening width between the guides 502 is acquired from the output value of the rotation angle sensor of the rotation member 510. At this time, the opening width between the guides 502 can be acquired by looking up, for example, a table describing the relationship between the output value of the rotation angle sensor and the opening width between the guides 502. The process advances to step S1903, and the CPU 201 calculates a flap size. More specifically, the CPU 201 sets, as the flap size, a difference calculated by subtracting the reference size acquired in step S1901 from the opening width between the guides 502 that has been acquired in step S1902.

Then, the process advances to step S1904, and the CPU 201 determines whether the flap size calculated in step S1903 is a value within a normal range. When paper (envelope) is not appropriately set on the manual feed tray 304 or the guides 502 are excessively opened with respect to the paper width, the opening width acquired in step S1902 may not indicate a normal value. In consideration of this, when the flap size calculated in step S1903 is smaller than a predetermined lower limit value or larger than a predetermined upper limit value, the CPU 201 determines that the flap size is not a normal value. If the CPU 201 determines that the flap size is a normal value, it advances the process to step S1905; if NO, to step S1906. In step S1905, the CPU 201 updates the data shown in Table 3 by using the flap size calculated in step S1903. For example, when the flap size calculated in step S1903 is 30 mm, the items of end-opening envelope (long format) 3 in Table 3 are updated as shown in Table 5. In step S1906, the CPU 201 discards the flap size calculated in step S1903. Also, in step S1906, the CPU 201 sets the flap size in Table 3 to be 0 mm, in order to ensure consistency with steps S1807 to S1811 of FIG. 18 (to be described later). After the end of processing in step S1905 or S1906, the CPU 201 ends the flap size calculation processing in step S1805, and advances the process to step S1806 of FIG. 18. In this manner, the CPU 201 identifies the flap size of the envelope (set on the manual feed tray 304).

TABLE 5

| Envelope Size | Reference Size | Auto Flag | Flap Size |
|---|---|---|---|
| 4: End-opening Envelope (Long Format) 3 | 235 mm | Yes | 30.0 mm |

In step S1806, the CPU 201 acquires a flap size. The flap size acquired here is a flap size manually entered by the user via the screen of FIG. 16, or a flap size calculated by the CPU 201 in step S1805. The flap size serves as an offset amount candidate. When no flap size is set, the flap size is 0 mm and the offset amount candidate becomes 0 mm. At this time, if the flap size is equal to or lower than a given threshold (for example, equal to or lower than 0 mm), the CPU 201 may determine that this flap size is abnormal, and interrupt the job. This processing is implemented by performing processes in steps S1809 to S1811. If the job is not interrupted, the CPU 201 performs processing in step S1808.

In step S1807, the CPU 201 determines whether the flap size is equal to or smaller than the threshold. If the flap size is equal to or smaller than the threshold, the process advances to step S1809, and the CPU 201 interrupts the job and displays a screen shown in FIG. 22 on the display unit 203 of the operation unit 106.

Figure 22:
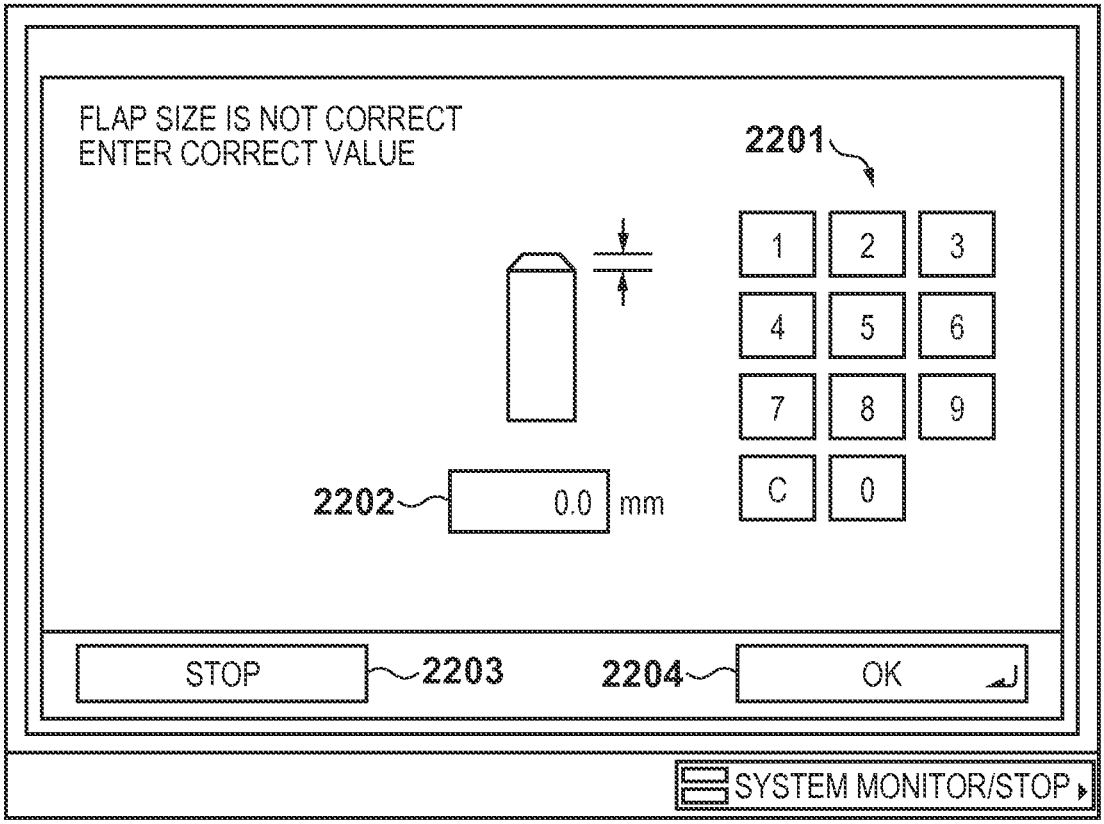
FIG. 22 is a view exemplifying a UI screen displayed on the display unit of the operation unit when a flap size is abnormal.

FIG. 22 is a view exemplifying a UI screen displayed on the display unit 203 of the operation unit 106 when a flap size is abnormal.

In step S1809, the CPU 201 displays the screen shown in FIG. 22 on the display unit 203, notifies the user that the flap size is abnormal, and prompts him to select whether to continue the job or set again the flap size. If the user wants to continue the processing, the current flap size is displayed in a flap size display area 2202, and the user enters a normal value by using a ten-key pad 2201. When the user presses an OK button 2204 after entering the flap size, the CPU 201 sets the entered value as the flap size, and updates (sets again) the flap size in Table 3 (step S1811). If the user wants to stop the job, he presses a stop button 2203, and the CPU 201 ends the job ("NO" in step S1810).

If the CPU 201 determines in step S1807 that the flap size is larger than the threshold, the process advances to step S1808, and the CPU 201 sets the flap size acquired in step S1806 as the offset amount.

If the CPU 201 determines in step S1802 that no coincident size exists, the process advances to step S1803, and the CPU 201 sets the offset amount to be 0 mm, continues the processing, and returns to the processing in FIG. 17B.

As described above, by detecting the opening width between the guides 502, a flap size corresponding to a standard envelope size can be automatically acquired. Even if, for example, a job for image data of a size not containing a flap size is input as a PDL job from a PC or the like, an image can be printed at an appropriate position on an envelope in consideration of the flap.

In the above-described embodiment, a flap size is automatically calculated in printing. However, a flap size may be calculated when paper is set. More specifically, when the user presses the auto button 1416 in FIG. 16, the calculation processing in FIG. 19 may be executed. In this case, the processes in steps S1804 and S1805 of FIG. 18 become unnecessary. At the start of the processing in FIG. 17B, the flap size in Table 3 has already been set, and the processing can proceed similarly to a case in which a flap size is set manually.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-036762, filed Feb. 22, 2012, which is hereby incorporated by reference herein in its entirety.

What is claimed is:

1. A printing apparatus comprising:

a holding unit configured to hold an envelope;

a detection unit configured to detect a position of guides for guiding an envelope held by said holding unit;

a first determination unit configured to determine a flap length of the envelope based on the position of the guides detected by said detection unit and a reference size set for the envelope held by said holding unit; and a printing unit configured to print an image on the envelope based on the flap length determined by said first determination unit.

2. The apparatus according to claim 1, further comprising an instruction unit configured to issue an instruction to automatically determine a flap length of the envelope held by said holding unit, wherein said first determination unit is configured to determine the flap length of the envelope in accordance with the instruction from said instruction unit.

3. The apparatus according to claim 1, wherein said first determination unit determines the flap length of the envelope based on a difference between an opening width between the guides and the reference size.

4. The apparatus according to claim 1, further comprising a second determination unit configured to determine, based on whether or not the flap length determined by said first determination unit is a value within a predetermined range, whether or not the flap length determined by said first determination unit is normal.

5. The apparatus according to claim 1, further comprising a setting unit configured to manually set a flap length of the envelope.

6. The apparatus according to claim 1, wherein the reference size is set as a size of an envelope from which a flap is excluded.

7. The apparatus according to claim 6, wherein the reference size is accepted from a user.

8. The apparatus according to claim 1, wherein the detection unit is configured to detect an opening width between the guides.

9. The apparatus according to claim 1, wherein the printing unit is configured to shift, based on the flap length determined by said first determination unit, a position to which the image is printed.

10. A method for controlling a printing apparatus including a sheet holding unit configured to hold an envelope, comprising steps of:

detecting a position of guides for guiding an envelope held by the sheet holding unit;

determining a flap length of the envelope based on the position of the guides detected in the detecting step and a reference size set for the envelope held by the holding unit; and printing an image on the envelope based on the flap length determined in the determining step.

11. A non-transitory computer-readable storage medium storing a computer program for causing a computer to execute steps of the method for controlling the printing apparatus including a holding unit configured to hold an envelope, the method comprising steps of:

detecting a position of guides for guiding an envelope held by the holding unit;

determining a flap length of the envelope based on the position of the guides detected in the detecting step and a reference size set for the envelope held by the holding unit; and printing an image on the envelope based on the flap length determined in the determining step.

* * * * *